US008313344B2

(12) United States Patent
Johnescu et al.

(10) Patent No.: US 8,313,344 B2
(45) Date of Patent: Nov. 20, 2012

(54) EYE-OF-THE-NEEDLE MOUNTING TERMINAL

(75) Inventors: Douglas M. Johnescu, York, PA (US); Daniel V. Nardone, Harrisburg, PA (US)

(73) Assignee: FCI Americas Technology LLC, Carson City, NV (US)

( * ) Notice: Subject to any disclaimer, the term of this patent is extended or adjusted under 35 U.S.C. 154(b) by 23 days.

(21) Appl. No.: 12/973,614

(22) Filed: Dec. 20, 2010

(65) Prior Publication Data

US 2011/0159743 A1 Jun. 30, 2011

Related U.S. Application Data

(60) Provisional application No. 61/291,002, filed on Dec. 30, 2009.

(51) Int. Cl.
*H01R 13/42* (2006.01)

(52) U.S. Cl. ..... 439/571

(58) Field of Classification Search ..... 439/571, 439/79, 567, 252, 810, 877, 943, 82, 84
See application file for complete search history.

(56) References Cited

U.S. PATENT DOCUMENTS

| | | | | |
|---|---|---|---|---|
| 2,329,471 | A | 9/1943 | King | |
| 3,581,272 | A * | 5/1971 | Yopp et al. | 439/825 |
| 3,717,841 | A | 2/1973 | Mancini | |
| 3,848,948 | A * | 11/1974 | Soes | 439/252 |
| 4,384,757 | A * | 5/1983 | Andrews et al. | 439/736 |
| 4,416,504 | A | 11/1983 | Sochor | |
| 4,676,579 | A | 6/1987 | Ting | |
| 4,857,018 | A | 8/1989 | Pickles | |
| 5,282,758 | A * | 2/1994 | Onoue | 439/395 |
| 5,564,954 | A | 10/1996 | Wurster | |
| 5,664,970 | A | 9/1997 | Millhimes et al. | |
| 5,893,779 | A | 4/1999 | Bianca et al. | |
| 6,077,128 | A | 6/2000 | Maag et al. | |
| 6,190,214 | B1 | 2/2001 | Bianca et al. | |
| 7,008,272 | B2 | 3/2006 | Blossfeld | |
| 7,540,744 | B1 | 6/2009 | Minich | |
| 7,762,843 | B2 | 7/2010 | Minich | |
| 8,092,262 | B1 | 1/2012 | Frederick et al. | |
| 2007/0212907 | A1 | 9/2007 | Kramski | |

OTHER PUBLICATIONS

Onanon News 3, "Onanon Compliant Pins Allow Solderless Mating of PSBs to Connectors", http://www.onanon.com/news3.htm, © 2009, accessed Jan. 6, 2010, 3 pages.

* cited by examiner

*Primary Examiner* — Alexander Gilman
(74) *Attorney, Agent, or Firm* — Woodcock Washburn LLP

(57) ABSTRACT

An electrical contact is provided having an eye-of-the-needle (EON) mounting terminal that has a reduced stub capacitance with respect to conventional eye-of-the-needle mounting terminals.

20 Claims, 9 Drawing Sheets

EYE-OF-THE-NEEDLE MOUNTING TERMINAL

CROSS-REFERENCE TO RELATED APPLICATIONS

This patent application claims priority to U.S. provisional patent application No. 61/291,002, filed Dec. 30, 2009, which is incorporated herein by reference in its entirety.

BACKGROUND

Electrical connectors typically include a housing that supports a plurality of electrical contacts that each define a mating end and an opposing mounting terminal. The mating ends define a mating interface configured to mate with a complementary mating interface of an electrical component, which can be another electrical connector or alternative electrical device. The mounting terminals define a mounting interface configured to connect to a substrate, such as a printed circuit board (PCB).

Plated through holes extend from an upper surface of a printed circuit board to an opposite, parallel lower surface of a PCB. Electrical connectors are mounted to the upper surface of the PCB such that electrical press-fit tails of the electrical contacts extend into the plated through holes. A typical press-fit tail 88 is shown in FIG. 3. When the length of a plated through hole exceeds the length of an electrical connector press-fit tail, the plated through hole can be backdrilled from the lower surface of the PCT in order to remove unused plating material in the plated through hole.

Referring to FIG. 3, an electrical contact 85 includes a contact body 86 and a mounting terminal 87 that extends distally from the contact body 86. The mounting terminal 87 defines a press-fit tail 88 that is shaped generally as an eye-of-the-needle (EON) that is configured to compress when inserted into a through hole which can be a plated through hole or via of a printed circuit board. The mounting terminal 87 includes a pair of beams 89 connected at their proximal and distal ends, and a substantially oval-shaped opening 90 that is disposed between the beams 89. The opening 90 defines a width of approximately 0.25 mm and a length of approximately 0.8 mm. The mounting terminal 87 further includes a neck connected between the contact body 86 and the beams 89 having a length of approximately 0.44 mm. The beams 89 define outer sides 91 that define a width therebetween of approximately 0.55 mm.

The mounting terminal 87 defines an overall length of approximately 1.45 mm, a penetration length into the underlying substrate of approximately 1.25 mm, and a stub length SL of approximately 0.58 mm. The stub length of the mounting terminal 87 is the distance between the location where the mounting terminal 87 mates with the inner surface of the via and the distal or free end of the mounting terminal 87. The stub length SL of the mounting terminal 87 can, in some instances, be the same as the through hole stub length, which is the distance between the location where the mounting terminal 87 mates with the inner surface of the via and the end of the via plating. Often, however, the plated through holes are backdrilled so as to remove a quantity of excess plating that extends distal of the location where the mounting terminal 87 mates with the inner surface of the via, thereby reducing the stub capacitance of the plated through hole.

SUMMARY

In accordance with one aspect of the present disclosure, a mounting terminal is configured as a press-fit tail having a reduced stub length that, in turn, permits a reduced though hole stub length while achieving desirable insertion and withdrawal forces. In general, one embodiment includes reducing a stub length of a mounting terminal in the form of a press fit tail as measured between where the mounting terminal mates with an inner surface of a plated through hole and the distal or free end of the terminal. Reductions in the stub length of the mounting terminal are typically associated with more acute angles toward the free end of the mounting terminal in order to maintain a lead-in for the press-fit pin. One embodiment of the present invention provides a mounting terminal having a reduced stub length that also provides a desirable lead-in and retention force, while at the same time allowing for a reduction in plated through hole stub length and a corresponding reduction in stub capacitance.

In accordance with one embodiment, a mounting terminal of an electrical contact extends distally from a distal surface of a contact body. The mounting terminal includes a pair of opposed resilient beams defining respective proximal ends, respective distal ends opposite the proximal ends, and respective intermediate regions disposed between the proximal and distal ends, wherein the pair of opposed resilient beams are each joined at their proximal ends or are each joined at one proximal end and are spaced apart at an opposed proximal end. Each of the beams defines a diverging proximal section extending distally between the proximal end and the intermediate region, and a converging lower section extending distally between the intermediate region and the distal end, so as to define an opening disposed between the beams, wherein the opening is substantially keyhole-shaped. Lead-in of the mounting terminal is maintained, and free length is reduced, when the mounting terminal has open proximal ends. Open proximal ends eliminates sharp acute angles between where the mounting terminal mates with the inner surface of a through hole to the distal or free end of the terminal. Generally, it is found that increasing a space between proximal ends of the two opposed resilient beams as the length of the two opposed resilient beams decreases provides a commercially acceptable lead-in for the mounting terminal and results in a commercially acceptable through hole retention force. Overlapping proximal ends also reduces spring-back of the opposed resilient beams of the mounting terminal.

BRIEF DESCRIPTION OF THE DRAWINGS

The foregoing summary, as well as the following detailed description of the preferred embodiments of the application, will be better understood when read in conjunction with the appended drawings. For the purposes of illustrating the eye-of-the-needle electrical contacts of the instant application, there are shown in the drawings preferred embodiments. It should be understood, however, that the instant application is not limited to the precise arrangements and/or instrumentalities illustrated in the drawings, in which.

DETAILED DESCRIPTION

Figure 1:
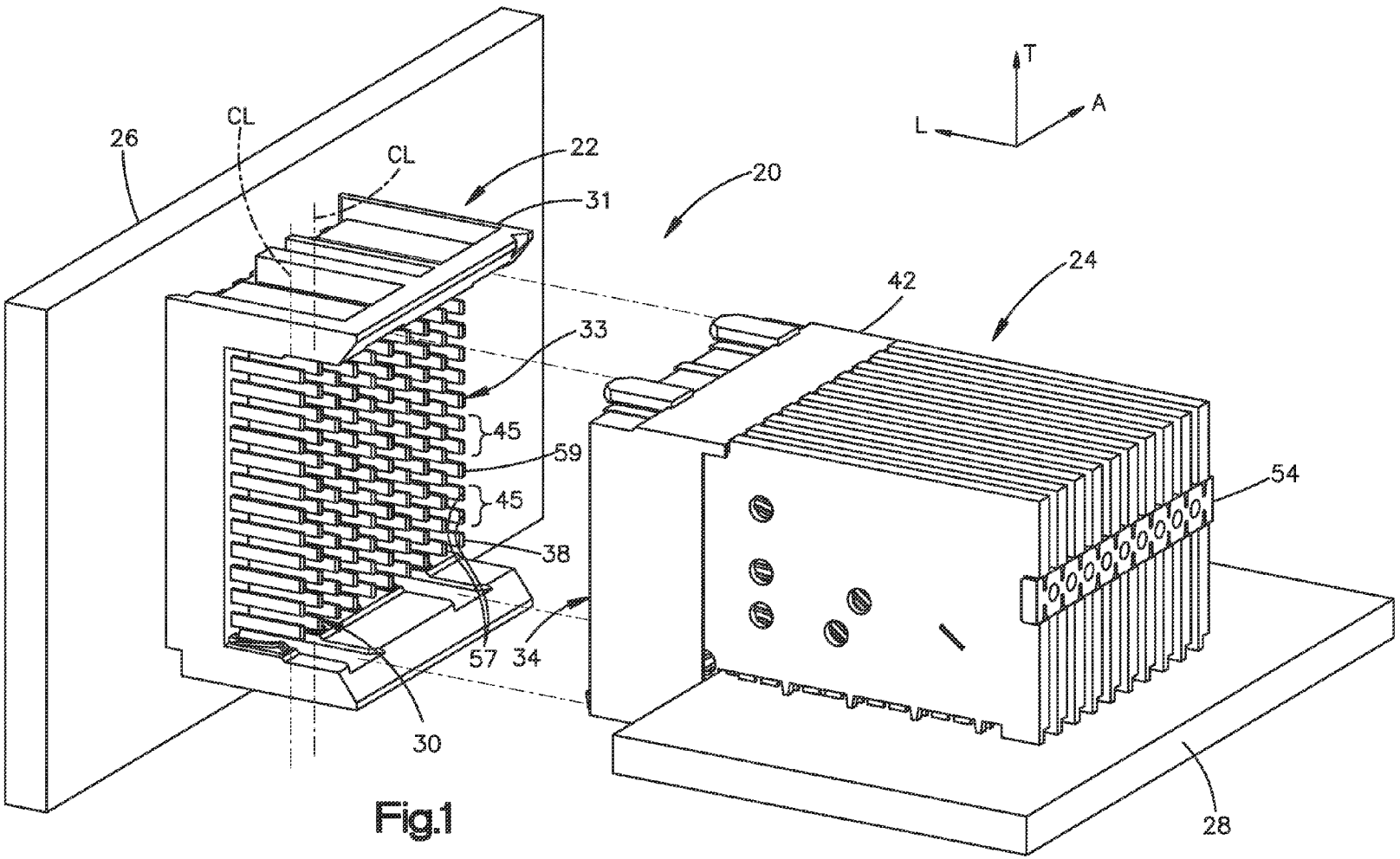
FIG. 1 is a perspective view of an electrical connector assembly including a vertical header connector and a right-angle receptacle connector mounted to respective substrates.

For convenience, the same or equivalent elements in the various embodiments illustrated in the drawings have been identified with the same reference numerals. Certain terminology is used in the following description for convenience only and is not limiting. The words "right", "left", "upper," and "lower" designate directions in the drawings to which reference is made. The words "inward", "inwardly", "outward", "outwardly," "upward," "upwardly," "downward," and "downwardly" refer to directions toward and away from, respectively, the geometric center of the device and designated parts thereof. The words "bias," "biased," and "biasing" refer to causing the object or objects being referred to, and designated parts thereof, to change position, for example by compressing, expanding, inserting, removing, pushing, pulling, drawing, or otherwise applying force thereto. The terminology intended to be non-limiting includes the above-listed words, derivatives thereof and words of similar import.

Figure 2A:
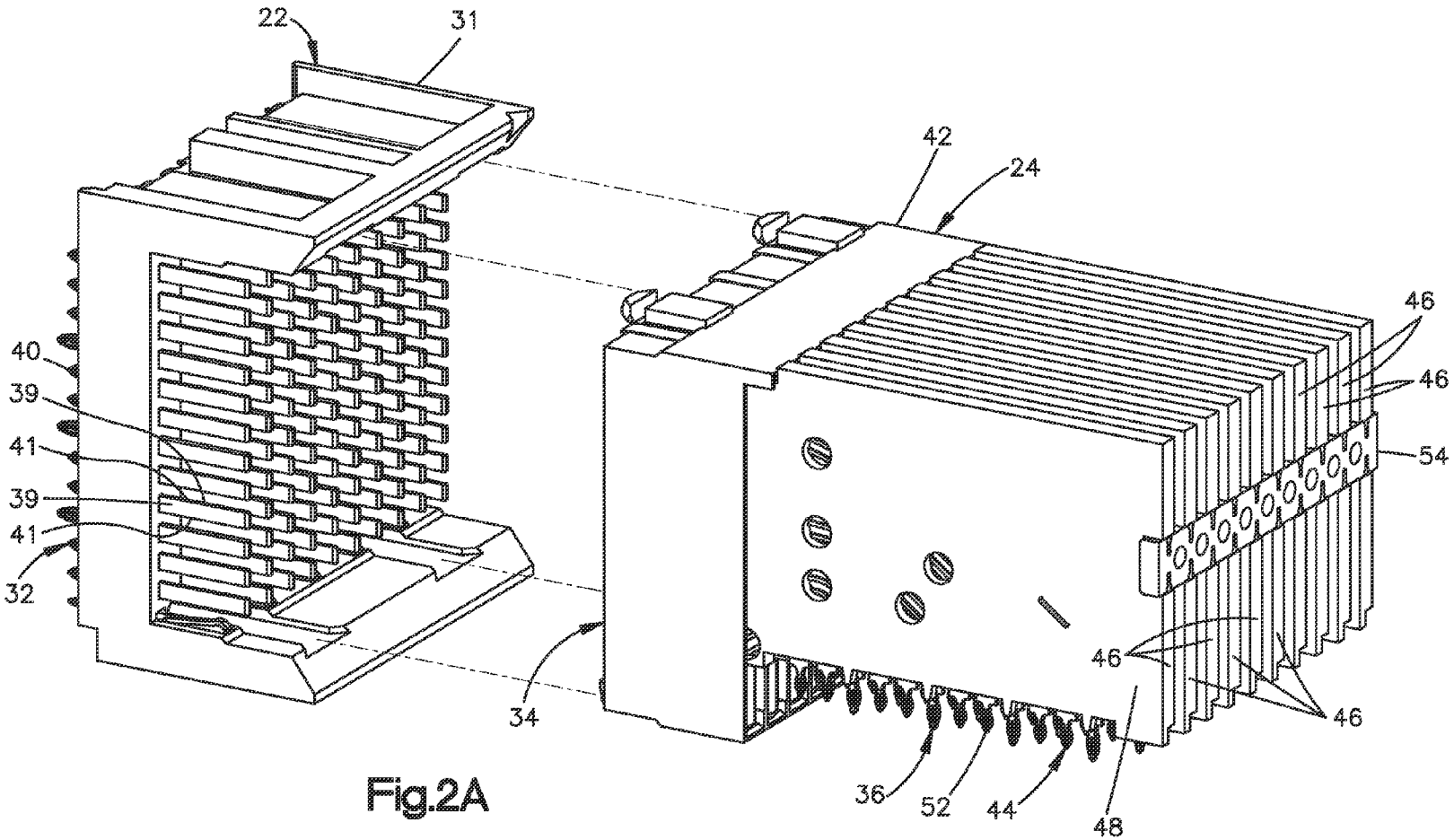
FIG. 2A is a perspective view of the electrical connector assembly similar to FIG. 1, but without the substrates.
Figure 2B:
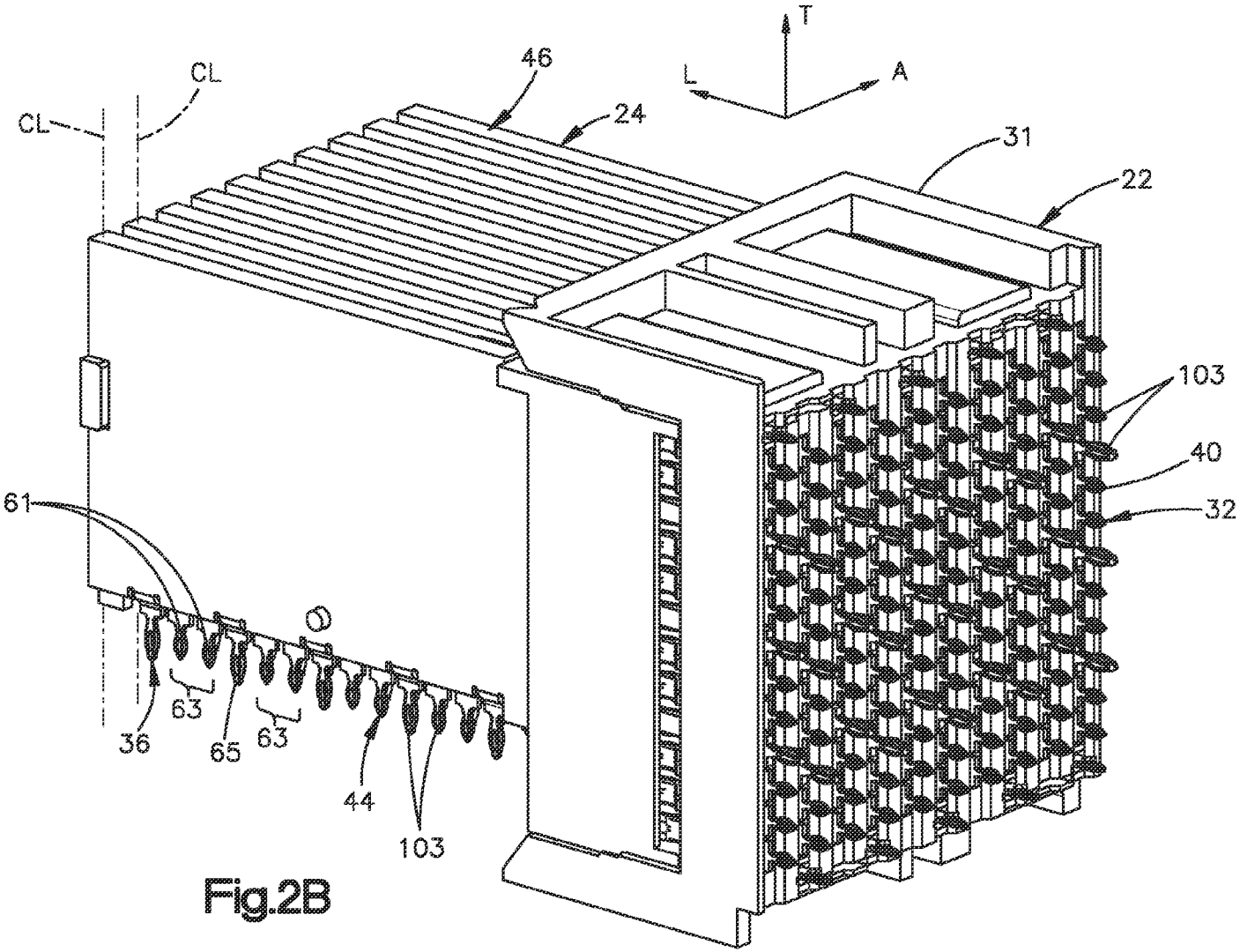
FIG. 2B is another perspective view of the electrical connector assembly as illustrated in FIG. 2A, but showing the electrical connectors in a mated configuration.

Referring initially to FIGS. 1-2B, an electrical connector assembly 20 includes a first electrical connector 22 and a second electrical connector 24 configured to mate with each other so as to establish an electrical connection between complementary electrical components, such as substrates 26 and 28. In accordance with the illustrated embodiment, each substrate 26 and 28 defines a printed circuit board (PCB). As shown, the first electrical connector 22 can be a vertical connector defining a mating interface 30 and a mounting interface 32 that extends substantially parallel to the mating interface 30. The second electrical connector 24 can be a right-angle connector defining a mating interface 34 and a mounting interface 36 that extends substantially perpendicular to the mating interface 34.

The first electrical connector 22 includes a dielectric housing 31 that carries a plurality of electrical contacts 33, which can include signal contacts and ground contacts. The electrical contacts 33 may be insert molded prior to attachment to the housing 31 or stitched into the housing 31. The electrical contacts 33 define respective mating ends 38 that extend along the mating interface 30, and mounting terminals 40 that extend along the mounting interface 32. Each of the electrical contacts 33 can define respective first and second opposed broadsides 39 and first and second edges 41 connected between the broadsides. The edges 41 define a length less than that of the broadsides 39, such that the electrical contacts 33 define a rectangular cross section. The mounting terminals 40 define press-fit tails that 203 are configured to extend into a plated through-hole of a complementary electrical component such as the substrate 26, which can be configured as a backplane, midplane, daughtercard, or the like.

The electrical contacts 33 can include signal contacts 57 that can be signal ended, or configured such that adjacent signal contacts 57 define differential signal pairs 45. The electrical contacts 33 can further include ground contacts 59 that can be disposed between adjacent signal contacts 57, and in particular between adjacent differential signal pairs 45. In accordance with one embodiment, the differential signal pairs 45 are edge coupled, that is the edges 39 of each electrical contact 33 of a given differential pair 45 face each other along a common column CL. Thus, the electrical connector 22 can include a plurality of differential signal pairs arranged along a given column CL. As illustrated, the electrical connector 22 can include four differential signal pairs 45 positioned edge-to-edge along the column CL, though the electrical connector 22 can include any number of differential signal pairs along a given centerline as desired, such as two, three, four, five, six, or more differential signal pairs.

Because the mating ends 38 of the electrical contacts 33 are configured as plugs, the first electrical connector 22 can be referred to as a plug or header connector. Furthermore, because the mating interface 30 is oriented substantially parallel to the mounting interface 32, the first electrical connector 22 can be referred to as a vertical connector, though it should be appreciated that the first electrical connector can be provided in any desired configuration so as to electrically connect the substrate 26 to the second electrical connector 24. For instance, the first electrical connector 22 can be provided as a receptacle connector whose electrical contacts are configured to receive plugs of a complementary electrical connector that is to be mated. Additionally, the first electrical connector 22 can be configured as a right-angle connector, whereby the mating interface 30 is oriented substantially perpendicular to the mounting interface 32, and co-planar with the mounting interface 34.

With continuing reference to FIGS. 1-2B, the second electrical connector 24 includes a dielectric housing 42 that retains a plurality of electrical contacts 44. In accordance with the illustrated embodiment, the housing 42 retains a plurality of leadframe assemblies 46 that are arranged along a lateral row direction. Each leadframe assembly 46 can be constructed in general as described in U.S. patent application Ser. No. 12/396,086. Each leadframe assembly 46 thus includes a dielectric leadframe housing 48 that carries a plurality of electrical contacts 44 arranged along a common transverse column CL.

The electrical contacts 44 define a respective receptacle mating ends that extend along the mating interface 34, and opposed mounting terminals 52 that extend along the mounting interface 36. Each mating end of the electrical contacts 44 extends horizontally forward along a longitudinal or first direction L, and each mounting terminal 52 extends vertically down along a transverse or second direction T that is substantially perpendicular to the longitudinal direction L. The leadframe assemblies 46 are arranged adjacent each other along a lateral or third direction A that is substantially perpendicular to both the transverse direction T and the longitudinal direction L.

Thus, as illustrated, the longitudinal direction L and the lateral direction A extend horizontally as illustrated, and the transverse direction T extends vertically, though it should be appreciated that these directions may change depending, for instance, on the orientation of the electrical connector 24 during use. Unless otherwise specified herein, the terms "lateral," "longitudinal," and "transverse" are used to describe the perpendicular directional components of various components. The terms "inboard" and "inner," and "outboard" and "outer" with respect to a specified directional component are used herein with respect to a given apparatus to refer to directions along the directional component toward and away from the center apparatus, respectively. The longitudinally forward direction can also be referred to an insertion or mating direction, as the connectors 22 and 24 can be mated when the electrical connector 24 is brought toward the electrical connector 22 when the electrical connector 24 is brought toward the electrical connector 22 in the longitudinally forward direction.

The electrical contacts 44 can include signal contacts 61 that can be signal ended, or configured such that adjacent signal contacts 61 define differential signal pairs 63. The electrical contacts 44 can further include ground contacts 65 that can be disposed between adjacent signal contacts 61, and in particular between adjacent differential signal pairs 63. In accordance with one embodiment, the differential signal pairs 63 are edge coupled, that is the edges of each electrical contact 44 of a given differential pair 63 face each other along a common column CL. The mating ends of the electrical contacts 44 are configured to electrically connect to the mating ends 38 of the complementary electrical contacts 33 when the electrical connectors 22 and 24 are mated, such that the signal contacts 57 and 61 mate, and ground contacts 59 and 65 mate. The mounting terminals 52 can be constructed as described above with respect to the mounting terminals 40 of the electrical contacts 33, and thus can define press-fit tails 103 that are configured to extend into a plated through-hole of a complementary electrical component such as the substrate 28, which can be configured as a backplane, midplane, daughtercard, or the like.

The electrical contacts 33 and 44 may define a lateral material thickness of about 0.1 mm to 0.5 mm and a transverse length of about 0.6 mm to 1.25 mm. The contact longitudinal width may vary over the length of the contacts. The electrical contacts 33 and 44 can be spaced apart at any distance as desired, as described in U.S. patent application Ser. No. 12/396,086. The second electrical connector 24 also may include an IMLA organizer 54 that may be electrically insulated or electrically conductive, and retains the IMLAs or lead frame assemblies 46.

Because the mating ends of the electrical contacts 44 and the mounting terminals 52 of the electrical contacts 44 are substantially perpendicular to each other, the electrical contacts 44 can be referred to as right-angle electrical contacts. Similarly, because the mating interface 30 is substantially parallel to the mounting interface 32, the second electrical connector 24 can be provided as a vertical header connector. Moreover, because the mating ends of the electrical contacts 44 are configured to receive the mating ends 38 of the complementary electrical contacts 33 configured as plugs, the electrical contacts 44 can be referred to as receptacle contacts. It should be appreciated, however, that the second electrical connector 24 can be provided in any desired configuration so as to electrically connect the substrate 28 to the first electrical connector 22. For instance, the second electrical connector 24 can be configured as a header connector, and can be further be configured as a vertical connector as desired. When the connectors 22 and 24 are mounted to their respective substrates 26 and 28 and mated with each other, the substrates 26 and 28 are placed in electrical communication.

Referring to FIGS. 4A-6C generally, the present inventors have recognized that merely decreasing the transverse length of the opening 90 of a conventional mounting tail, while allowing the overall transverse length and the stub length TSL of the mounting terminal, and thus the through hole stub length HSL (see FIG. 7B) to be reduced, can also create undesirable insertion and withdrawal forces.

Figure 4B:
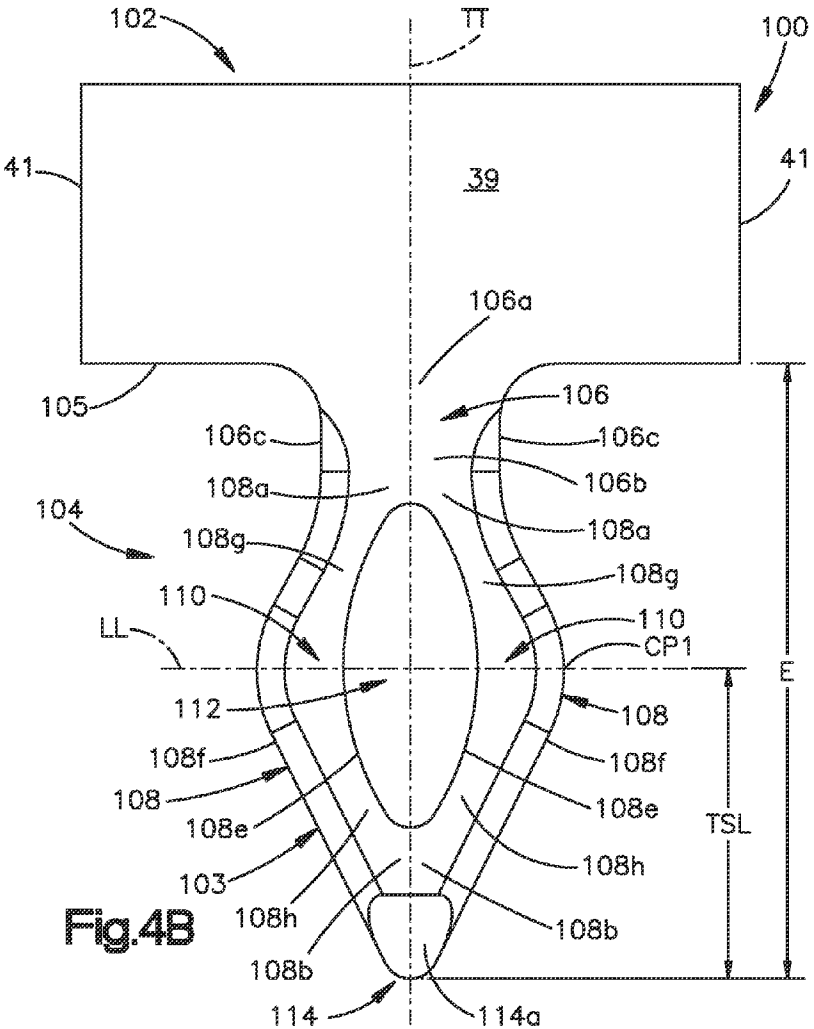
FIG. 4B is a front elevation view of the conventional mounting terminal illustrated in FIG. 4A.
Figure 4A:
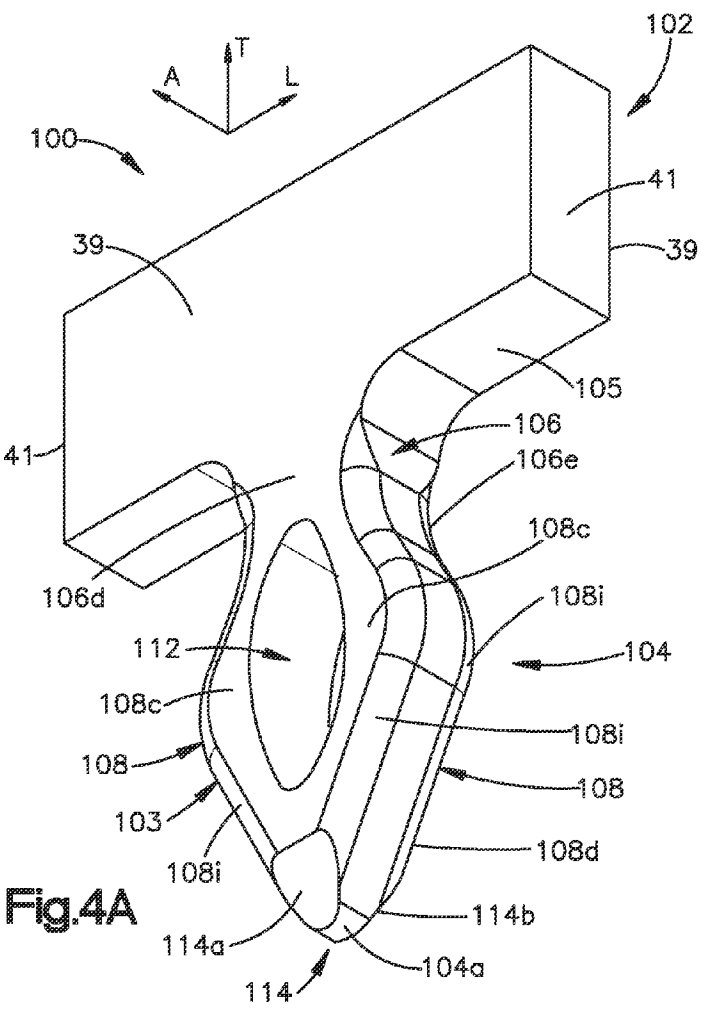
FIG. 4A is a perspective view of a mounting terminal of an electrical contact constructed in accordance with one embodiment and shown in a relaxed configuration.

Referring now to FIGS. 4A-B, an electrical contact 100 can be configured as described above with respect to the electrical contacts 33 of the first electrical connector 22, can alternatively be configured as described above with respect to the electrical contacts 44 of the second electrical connector 24, and can alternatively be configured as any suitable electrical contact as desired configured to carry electrical signals. For instance, the electrical contact 100 includes a body 102 that is conductive and can extend substantially straight between a mating end and an opposed mounting terminal that extends substantially parallel to the mating end such that the electrical contact 100 is a vertical contact, or the body 102 can extend substantially straight between a mating end and an opposed mounting terminal that extends substantially perpendicular to the mating end such that the electrical contact 100 is a right-angle contact.

The electrical contact 100 defines a mounting terminal 104 at one end of the body 102 and integral with the body 102. The mounting terminal 104 can define a press-fit tail 103 that is shaped generally as an eye-of-the-needle (EON) that is configured to compress when inserted into a through hole which can be a through hole 109 or via of a substrate 111, such as a printed circuit board (See FIGS. 7A-B). The electrical contact 100 can be constructed from copper alloys or any other suitable conductive material as desired.

The body 102 defines opposed broadsides 39 and opposed edges 41 extending between the broadsides 39 as described above, and a lower or distal surface 105 from which the mounting terminal 104, and in particular the press-fit tail 103, extends. The broadsides 39 are spaced apart along the lateral direction A, the edges 41 are spaced apart along the longitudinal direction L, and the press-fit tail 103 extends distally from the lower surface 105 along the transverse direction T. While the orientation of the longitudinal, lateral, and transverse directions may vary during use, the transverse direction T is described as defining a general press-fit mounting direction of the electrical contact 100 onto an underlying substrate.

Referring now to FIGS. 4A-B and 7A-B, the bottom surface 105 of the body 102 can be configured to engage or abut or otherwise face an upper, or mounting surface 113 of the underlying substrate 111, for example the upper surface into which a through hole 109 is formed. It should be appreciated that while the body 102 is illustrated as having a generally rectangular block shape, that any alternate body geometry can be utilized as desired. Furthermore the size and/or proportions of the body 102 should not be limited to the illustrated configuration. For example, while the body 102 is depicted as having a width in the longitudinal direction L between opposed edges 41 that is greater than the width of the mounting terminal 104, the body 102 can alternatively be configured to have a width equal to or less than the width of the mounting terminal 104. Furthermore, while the body 102 is depicted as having a thickness in the lateral direction A between the opposed edges 39 that is substantially equal to the thickness of the mounting terminal 104, the body 102 can alternatively be configured to have a thickness greater or less than the thickness of the mounting terminal 104. The mounting terminal 104 defines a distal end 104*a*, and a transverse length E, defined as the distance between the bottom surface 105 of the body 102 and the distal end 104*a* of the mounting terminal 104.

The press-fit tail 103 of the electrical contact 100 includes a pair of opposed resilient beams 108 and a neck 106 connected between the body 102, and in particular the bottom surface 105 of the body 102, and the beams 108. The neck 106 has a first proximal or upper end 106*a* that defines the proximal end of the mounting terminal 104 and is integral with the lower surface 105 of the body 102, a transversely opposed second or distal lower end 106*b*, longitudinally opposed side surfaces 106*c* that extend between the ends 106*a* and 106*b*, and laterally opposed front and back surfaces 106*d-e* that extend between the side surfaces 106 and further between the ends 106*a* and 106*b*. It should be appreciated that while the side, front, and back, surfaces 106*c-e* of the neck 106 are depicted as being generally parallel with respect to corresponding surfaces of the body 102, that the geometry of the neck 106 should not be so limited. For example, one or more surfaces of the neck 106 can be concave, thus lending the neck 106 a cinched geometry, or any other alternative neck geometry can be used as desired.

Each of the resilient beams 108 extends distally from the lower end 106*b* of the neck 106 between a first or proximal end 108*a* integrally connected to the lower end 106*b* of the neck 106 and a transversely opposed distal end 108*b*. The beams 108 are further integrally connected to each other or otherwise joined at the proximal end 108*a*. The beams 108 are further integrally connected or otherwise joined to each other at the distal end 108*b*. Each beam 108 further defines laterally opposed front and back surfaces 108*c-d* and a lateral thickness defined between the surfaces 108*c-d*, and a width between longitudinally opposed side surfaces 108*e-f*. The width varies along the length of the mounting terminal 104. It should be appreciated that while the front and back surfaces 108*c-d* of the beams 108 are depicted as being generally parallel with respect to corresponding surfaces of the body 102 and neck 106, that the surface geometries of the beams 108 should not be so limited, and that the beam can define any suitable alternative geometry as desired.

The beams 108 define respective upper or proximal diverging sections 108*g* that extend between the respective proximal end 108*a* and an intermediate region 110 that is disposed between the proximal ends 108*a* and distal ends 108*b*. The intermediate regions 110 are spaced apart along a longitudinal axis LL. The proximal diverging sections 108*g* flare away from each other in a downward or distal direction along the respective beam 108 from the lower end 106*b* of the neck 106, and terminate at the intermediate region 110, which defines a location of greatest distance between the beams 108 along the longitudinal direction L. At the intermediate region 110, the distance between the outer sides 108*f* of the opposed beams 108 is larger than the cross-sectional inner wall dimension D of a through hole 109 of the underlying substrate 111, which can be a plated through hole as desired that places the mounting terminal 104 in electrical communication with at least one electrical trace carried by the substrate 111. In the illustrated configuration, the intermediate regions 110 are defined at approximately the midpoints between the proximal and distal ends 108*a-b* of the beams 108, but it should be appreciated that the intermediate regions 110 can be defined anywhere along the beams 108 between the proximal and distal ends 108*a-b*, for example to affect the amount of insertion force and/or withdrawal force required to bias the electrical contact 100 into or out of the through hole 109. The beams 108 each define respective lower or distal converging sections 108*h* that extend between the intermediate region 110 and the respective distal ends 108*b*. The distal converging sections 108*h* taper toward each other in a downward or distal direction along the respective beam 108 from the respective intermediate region 110 to the distal end 108*b*.

In the illustrated configuration, the beams 108 are straight along the proximal diverging sections 108*g* between the proximal ends 108*a* and the intermediate regions 110, curved slightly at the intermediate regions 110 so as to be substantially concave with respect to the opposed beam 108, and substantially straight along the lower distal converging sections 108*h* between the intermediate regions 110 and the distal ends 108*b*. The thickness of the beams 108, as defined between the inner and outer sides 108*e-f*, increases through the proximal diverging sections 108*g* between the proximal ends 108*a* and the intermediate regions 110, reaches its greatest distance at the intermediate regions 110, and decreases though the distal converging sections 108*h* between the intermediate regions 110 and the distal ends 108*b*. However, this structure is not intended to be limiting, and the beams 108 can be curved, straight, of constant or varying thickness, or any combination thereof in the proximal diverging sections 108*g*, the distal converging sections 108*h*, and/or at the intermediate regions 110 that is disposed between the proximal diverging sections 108*g* and the distal converging sections 108*h*.

The mounting terminal 104 defines a through-hole or opening 112 that extends laterally through the press-fit tail 103 at a location between the opposed beams 108, so as to define inner sides 108*e* that at least partially define an outer perimeter of the opening 112. In particular, the opening extends between the opposed proximal diverging sections 108*g*, the opposed intermediate regions 110, and between the opposed distal converging sections 108*h*. The opening 112 of the illustrated configuration is substantially oval-shaped. Of course other geometries of the opening 112 can be used as desired, for example to affect the amount of insertion force and/or withdrawal force required to bias the electrical contact 100 into or out of the through hole 109 of the underlying substrate 111. The distal ends 108*b* of the beams 108 are integrally connected, defining a tip 114 at the distal end 104*a* of the mounting terminal 104. The tip 114 can be configured as desired for insertion into the underlying substrate 111, for instance into the through hole 109. For example, in the configuration depicted in FIGS. 4A-B, the tip 114 defines laterally opposed front and rear tip surfaces 114*a-b* that are beveled inwardly along the transverse distal. Of course the press-fit tail 103 can define any suitable alternative tip 114 geometry as desired.

At least a portion up to substantially an entirety of the inner and/or outer sides 108*e-f* of the beams 108 may be curved, for example to at least partially determine the amount of insertion force and/or withdrawal force that allows the press-fit tail 103 to be inserted into or withdrawn from the through hole 109. For example, in the illustrated configuration, a portion of the outer sides 108*f* of each beam 108, at respective intersections of the outer sides 108*f* and the front and back surfaces 108*c-d*, respectively, define curved edges 108*i*. The curved edges 108*i* can extend into the neck 106 as well in accordance with the illustrated embodiment. It should be appreciated that curved edges can also be formed at intersections between the inner sides 108*e* and the front and back surfaces 108*c-d* as desired.

During operation, the electrical contact 100 is inserted into a corresponding through hole 109 that extends into an upper surface 113 of an underlying substrate 111 that defines a lower surface 115 that is opposite the upper surface 113. The through hole 109 can extend through both the upper surface 113 and the lower surface 115, and is defined by an inner wall 117 of the substrate 111 that can be substantially cylindrical or alternatively shaped as desired. The underlying substrate 111 can further include a conductive plating 119 that extends along the inner wall 117. The through hole 109 can be back-drilled from the bottom surface 115 and into the through hole 109 so as to remove a portion of the conductive plating 119 proximate to the bottom surface 115. Thus, the press-fit tail 103 can be inserted into the through hole 109 such that the resilient beams 108 contact the plating 119 at respective contact points CP1 and CP2. The contact point CP1 of the beams 108 can be located on the outer sides 108*f* at a location of maximum distance between the outer sides along a direction parallel to the longitudinal axis LL. In accordance with the illustrated embodiment, the contact points CP1 can be disposed on the longitudinal axis LL. The mounting terminal 104, and in particular the press-fit tail 103, defines a stub length TSL that is the transverse distance between the contact point CP1 and the distal end of the tip 114.

The contact point CP2 of the through hole 109 can be disposed at a location whereby contact is made with the contact point CP1 of the press-fit tail 103 when the press-fit tail 103 is fully inserted into the through hole 109. The plating 119 can be backdrilled to any location as desired, for instance to a location that is substantially aligned with the tip 114 of the press-fit tail 103 when the press-fit tail 103 is fully inserted into the through hole 109. The through hole 109 defines a stub length HSL that is the transverse distance between the contact point CP2 and the lower end of the plating 119. The through hole stub length HSL can be substantially equal to, less than, or greater than the stub length TSL of the mounting terminal 104. It should be appreciated, however, that shorter mounting terminal stub length TSL allows for a correspondingly reduced through hole stub length HSL.

Because the distance between the outer sides 108*f* of the beams 108 at the contact points CP1 is larger than the cross-sectional dimension D of the plated through hole 109 as defined by the plating 119, the outer sides 108*f* along the lower sections 108*h* of the beams 108 come into contact with and ride along the plating 119 as the mounting terminal 104 is inserted through the through hole 109. As a distal force is applied to the electrical contact 100 that causes the press-fit tail 103 is press-fit mounted to the substrate 111, the beams 108 are compressed inwardly towards each other as the distal converging sections 108*h* are inserted into the through hole 109, creating an outwardly directed normal force against the plating 119 and the inner wall 117 and an inwardly directed normal force against the outer sides 108*f* of the beams 108. In this regard, it should be appreciated that both the tip 114 as well as the distal portions of the opposed distal converging sections 108*h* define a cross-sectional distance that is less than the cross-sectional distance D of the through hole 109. In accordance with the illustrated embodiment, a proximal portion of the opposed distal converging sections 108*h* (for instance adjacent the intermediate region 110) can define a cross-sectional distance parallel to the longitudinal axis LL that is greater than the cross-sectional dimension D of the through hole 109. A friction force is also generated against the outer sides 108*f* of the beams 108 and against the plating 119 as the mounting terminal 104 is press-fit mounted to the substrate 111. The cumulative friction forces can be defined as the insertion force required to insert the mounting terminal 104 of the electrical contact 100 into the through hole 109.

The press-fit tail 103 can be withdrawn from the through hole 109, if desired, by applying a proximal force to the electrical contact 100 with respect to the substrate 111 that causes the outer sides 108*f* along the proximal diverging sections 108*g* of the beams 108 ride along the plating 119, and thus the inner wall 117. A friction force is generated against the outer sides 108*f* of the beams 108 and against the plating 119 as the press-fit tail 103 advances proximally. The cumulative friction forces can be defined as the withdrawal, or retention, force required to remove the mounting terminal 104 of the electrical contact 100 from the printed circuit board.

In accordance with the illustrated embodiment, each beam 108 defines a thickness between the respective outer sides 108*f* and the inner sides 108*e* that is greater at the intermediate regions than at both the proximal diverging sections 108*g* and the distal converging sections 108*h*.

The mounting terminal 104 defines a transverse distance between the distal surface 105 and the intermediate regions 110 of approximately 0.55 mm, a transverse distance between the distal surface 105 and the proximal end of the opening 112 of approximately 0.25 mm, and a transverse distance between the distal surface 105 and the distal end of the opening 112 of approximately 0.83 mm. The opening 112 defines a maximum longitudinal width between the opposed inner sides 108*e* of approximately 0.24 mm, and the opposed intermediate regions 110 define a maximum longitudinal width between the opposed outer sides 108*f* of approximately 0.55 mm. Thus, the beams 108 can each define a thickness of approximately 0.115 mm.

It has been found that when the overall length between the distal surface 105 and the distal end of the tip 114 of the illustrated configuration is about 1.10 mm, the press-fit tail 103 extends about 0.90 mm into the through hole 109 when the press-fit tail 103 is fully inserted, thereby defining a penetration length into the through hole 109 of substantially 0.90 mm and a terminal stub length TSL of approximately 0.55 mm. The terminal stub length TSL can, in some instances, be the same as the distance between the contact point CP2 and the end of the plating 119. In accordance with the illustrated embodiment, the terminal stub length TSL is the distance between the location of the intermediate region 110 that defines the greatest cross-section parallel to the longitudinal axis LL and the end of the tip 114. Thus, the press-fit tail 103 defines a terminal stub length TSL that allows the corresponding through hole stub length HSL to be shorter than the through hole stub lengths associated with conventional press-fit tails, and the electrical contact 100 thus has a reduced stub capacitance. It has been found that the press-fit tail 103 provides a maximum insertion force of 22 Newtons (N). Otherwise stated, an insertion force of about 22 N applied distally to the press-fit tail 103 is sufficient to fully insert the press-fit tail 103 into the through hole 109.

Figure 4D:
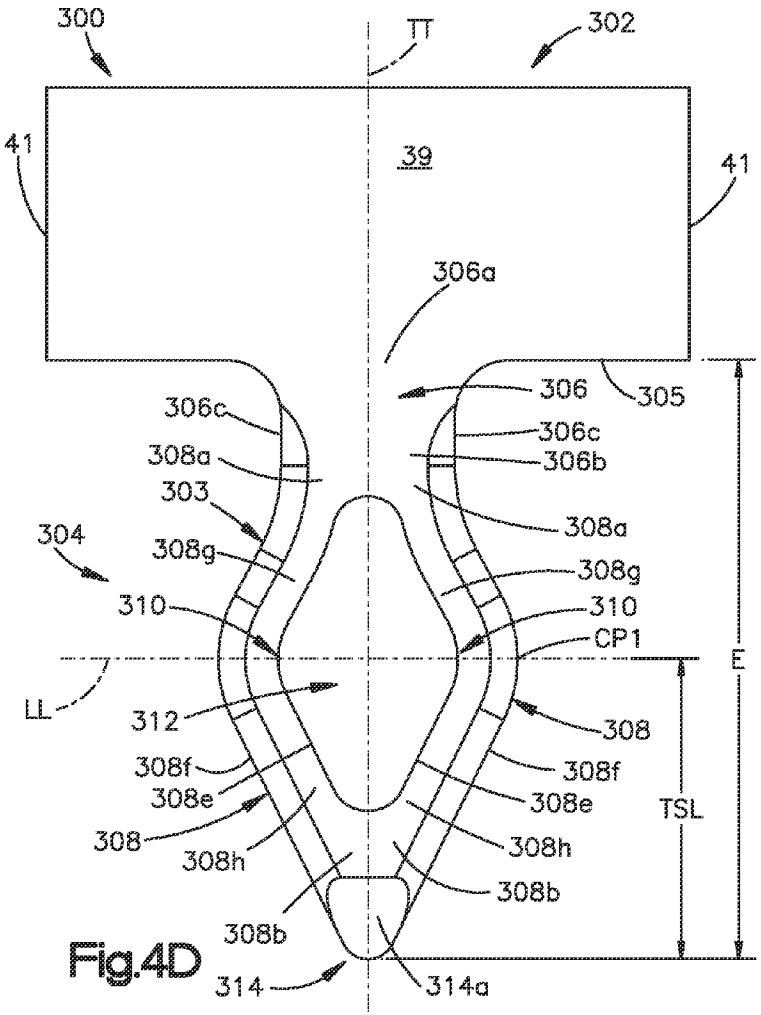
FIG. 4D is a front elevation view of a mounting terminal of an electrical contact similar to the mounting terminal illustrated in FIG. 4C, but constructed in accordance with another alternative embodiment and shown in a relaxed configuration.
Figure 4C:
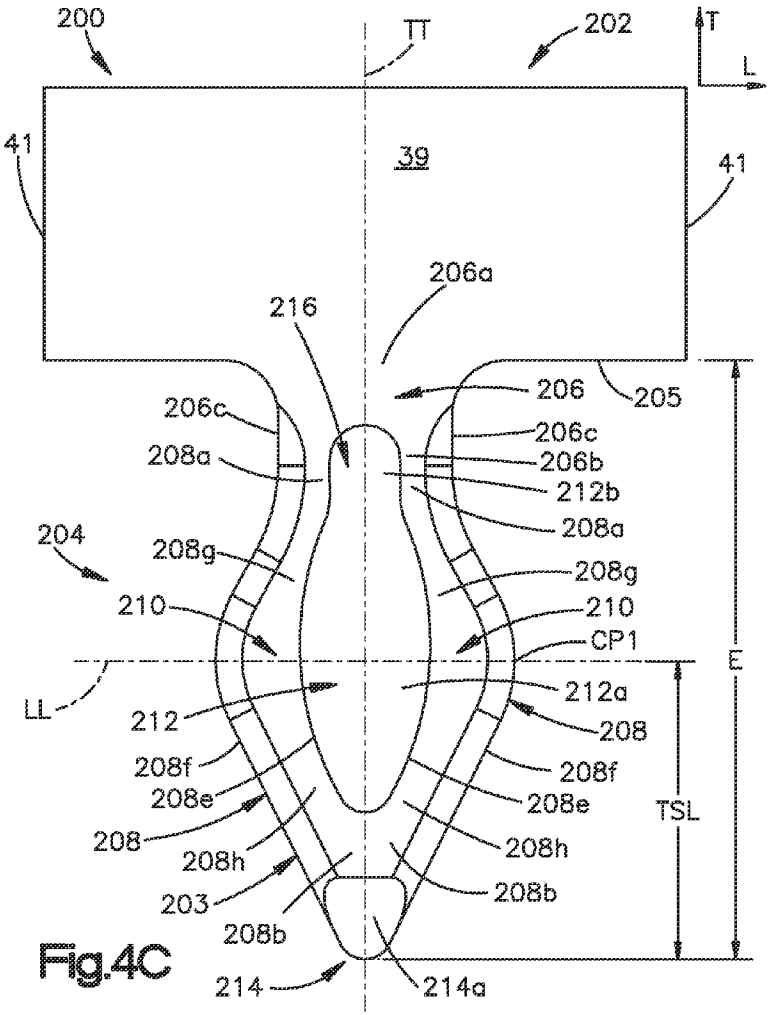
FIG. 4C is a front elevation view of a mounting terminal of an electrical contact similar to the mounting terminal illustrated in FIGS. 4A-B, but constructed in accordance with another embodiment and shown in a relaxed configuration.

Referring now to FIG. 4C, an electrical contact 200 can be configured as described above with respect to the electrical contacts 33 of the first electrical connector 22, can alternatively be configured as described above with respect to the electrical contacts 44 of the second electrical connector 24, and can alternatively be configured as any suitable electrical contact as desired configured to carry electrical signals. For instance, the electrical contact 200 includes a body 202 that is conductive and can extend substantially straight between a mating end and an opposed mounting terminal that extends substantially parallel to the mating end such that the electrical contact 200 is a vertical contact, or the body 202 can extend between a mating end and an opposed mounting terminal that extends substantially perpendicular to the mating end such that the electrical contact 200 is a right-angle contact.

The electrical contact 200 defines a mounting terminal 204 extending from one end of the body 202 and integral with the body 202. The mounting terminal 204 can define a press-fit tail 203 that extends along a central transverse axis TT, and is shaped generally as an eye-of-the-needle (EON) that is configured to compress when inserted into a through hole which can be a through hole 109 of a substrate 111, such as a printed circuit board (See FIGS. 7A-B).

The body 202 defines opposed broadsides 39 and opposed edges 41 extending between the broadsides 39 as described above, and a lower or distal surface 205 from which the mounting terminal 204, and in particular the press-fit tail 203, extends. The broadsides 39 are spaced apart along the lateral direction A, the edges 41 are spaced apart along the longitudinal direction L, and the press-fit tail 203 extends distally from the lower surface 205 along the transverse direction T. While the orientation of the longitudinal, lateral, and transverse directions may vary during use, the transverse direction T is described as defining a general press-fit mounting direction of the electrical contact 200 onto an underlying substrate.

Figure 7A:
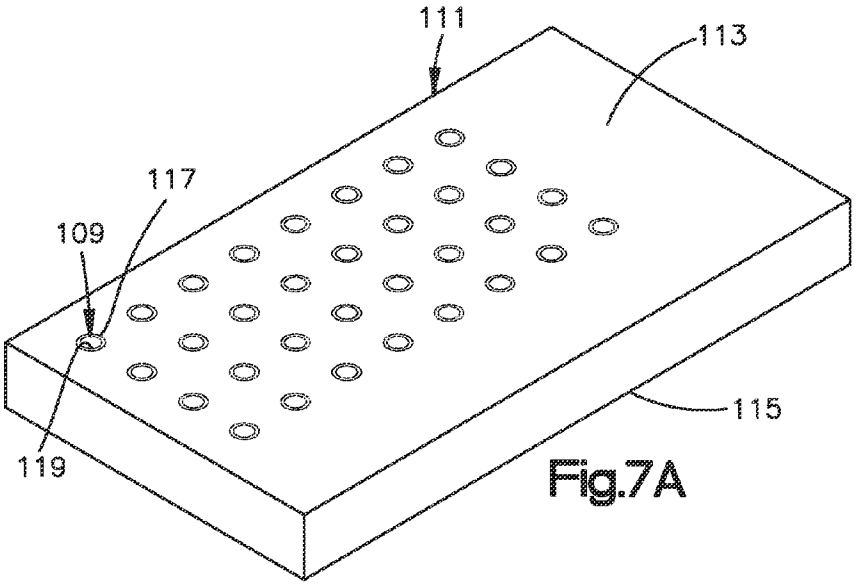
FIG. 7A is a perspective view of a substrate having a plurality of through holes configured to receive a mounting terminal of an electrical contact.
Figure 7B:
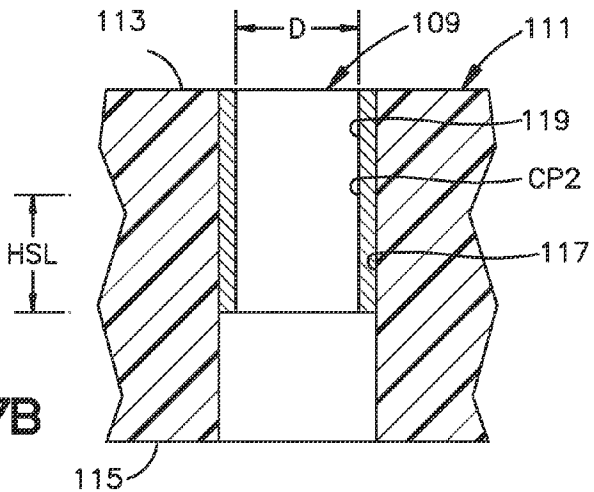
FIG. 7B is a sectional side elevation view of he substrate illustrated in FIG. 7A, taken along line 7B-7B.
Figure 3:
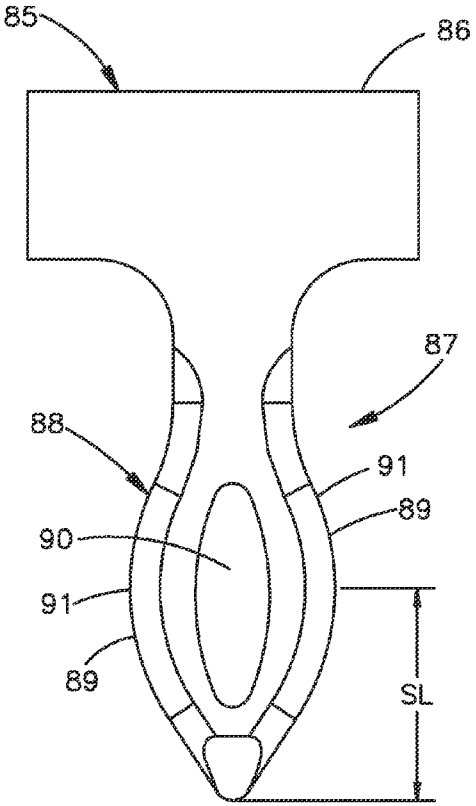
Fig.3 PRIOR ART
FIG. 3 is a front elevation view of a conventional mounting terminal of an electrical contact.

The bottom surface 205 of the body 202 can be configured to engage or abut an upper, or mounting surface 113 of the underlying substrate 109, for example the upper surface into which a through hole 109 is formed (see FIGS. 7A-B). It should be appreciated that while the body 202 is illustrated as having a generally rectangular block shape, the body 202 can alternatively define any suitable alternate geometry as desired. Furthermore the size and/or proportions of the body 202 should not be limited to the illustrated configuration. For example, while the body 202 is depicted as having a width in the longitudinal direction L between opposed edges 41 that is greater than the width of the mounting terminal 204, the body 202 can alternatively be configured to have a width equal to or less than the width of the mounting terminal 204. Furthermore, while the body 202 is depicted as having a thickness in the lateral direction A between the opposed edges 39 that is substantially equal to the thickness of the mounting terminal 204, the body 202 can alternatively be configured to have a thickness greater or less than the thickness of the mounting terminal 204. The mounting terminal 204 defines a distal end 204*a*, and a transverse length E, defined as the distance between the bottom surface 205 of the body 202 and the distal end 204*a* of the mounting terminal 204.

The press-fit tail 203 of the electrical contact 200 includes a pair of opposed resilient beams 208 that are similarly constructed, and substantial mirror images of each other with respect to the central transverse axis TT, and a neck 206 connected between the body 202, and in particular the bottom surface 205 of the body 202, and the beams 208. The neck 206 has a first proximal or upper end 206*a* that defines the proximal end of the mounting terminal 204 and is integral with the lower surface 205 of the body 202, a transversely opposed second or distal lower end 206*b*, longitudinally opposed side surfaces 206*c* that extend between the ends 206*a* and 206*b*, and laterally opposed front and back surfaces 206*d-e* that extend between the side surfaces 206 and further between the ends 206*a* and 206*b*. It should be appreciated that while the side, front, and back, surfaces 206*c-e* of the neck 206 are depicted as being generally parallel with respect to corresponding surfaces of the body 202, that the geometry of the neck 206 should not be so limited. For example, one or more surfaces of the neck 206 can be concave, such that the neck 206 can define a cinched geometry, or any other alternative geometry as desired.

Each of the resilient beams 208 extends distally from the lower end 206*b* of the neck 206 between a first or proximal end 208*a* integrally connected to the lower end 206*b* of the neck 206 and a transversely opposed distal end 208*b*. The beams 208 are further integrally connected or otherwise joined to each other at the proximal end 208*a*. The beams 208 are further integrally connected or otherwise joined to each other at the distal end 208*b*. Each beam 208 further defines laterally opposed front and back surfaces 208*c-d* and a lateral thickness defined between the surfaces 208*c-d*, and a width between longitudinally opposed side surfaces 208*e-f*. The width varies along the length of the mounting terminal 204. It should be appreciated that while the front and back surfaces 208*c-d* of the beams 208 are depicted as being generally parallel with respect to corresponding surfaces of the body 202 and neck 206, that the surface geometries of the beams 208 should not be so limited, and that the beam can define any suitable alternative geometry as desired.

The beams 208 define respective first upper or proximal diverging sections 208*g* that extend between the respective proximal end 208*a* and an intermediate region or intermediate region 210 that is disposed between the proximal ends 208*a* and the distal ends 208*b*. The proximal diverging sections 208*g* flare away from each other in a downward or distal direction along the respective beam 208 from the lower end 206*b* of the neck 206, and terminate at the intermediate region 210, which defines a location of greatest distance between the beams 208 along the longitudinal direction L. At the intermediate region 210, the distance between the outer sides 208*f* of the opposed beams 208 is larger than the cross-sectional inner wall dimension D of a through-hole 109 of the underlying substrate 111. In the illustrated configuration, the intermediate regions 210 are defined at approximately the midpoints between the proximal and distal ends 208*a-b* of the beams 208, but it should be appreciated that the intermediate regions 210 can be defined anywhere along the beams 108 between the proximal and distal ends 208*a-b*, for example to affect the amount of insertion force and/or withdrawal force required to bias the electrical contact 200 into or out of the through hole 109 of the printed circuit board 111. The beams 208 each define respective second lower or distal converging sections 208*h* that extend between the intermediate region 210 and the respective distal ends 208*b*. The distal converging sections 208*h* taper toward each other in a downward or distal direction along the respective beam 208 from the respective intermediate region 210 to the distal end 208*b*.

The distal ends 208*b* of the beams 208 are integrally connected, defining a tip 214 at the distal end 204*a* of the mounting terminal 204. The tip 214 can be configured as desired for insertion into the underlying substrate 111, for instance into the through hole 109. For example, in the configuration depicted in FIGS. 4A-B, the tip 214 defines laterally opposed front and rear tip surfaces 214*a-b* that are tapered inwardly toward each other along the transverse distal direction. Of course the press-fit tail 203 can define any suitable alternative tip 214 geometry as desired.

The inner and outer sides 208*e-f* of each of the proximal diverging sections 208*g* can flare away from each other along a distal direction toward the intermediate region 210. For instance, the outer side 208*f* can be curved so as to be concave with respect to the opposed outer side 208*f* of the opposed beam 208, and the inner side 208*e* can define a substantially straight transverse proximal end at the distal converging section 208*h*, and can define a curved distal portion that is concave with respect to the opposed inner side 208*e* of the opposed beam 208. The inner and outer sides 208*e-f* of each of the distal converging sections 208*h* can be tapered toward each other along a distal direction toward the tip 214. For instance, the outer side 208*f* at the distal converging sections 208*h* can be substantially straight and extend inwardly toward the opposed distal converging section 208*h* of the opposed beam 208 along a direction between the intermediate region 210 and the tip 214. The inner side 208*e* at the distal converging sections 208*h* can be curved so as to be concave with respect to the opposed inner side 208*e* of the opposed beam 208. Thus, it can be said that the outer sides 208*f* at the proximal diverging sections 208*g* have a curvature greater than at the distal converging sections 208*h*, where the curvature of the outer sides 208*f* can be substantially zero.

The thickness of the beams 208 at the proximal diverging sections 208*g* between the inner and outer sides 208*e-f* can increase along a distal direction to the intermediate regions 210, which defines the region of maximum thickness between the inner and outer sides 208*e-f* of the beams 208. Thus, the intermediate regions 210 define a thickness between the inner and outer sides 208*e-f* greater than that of the proximal diverging portion 208*g* and the distal converging portion 208*h*. The distal converging portion 208*h* defines a thickness between the inner and outer sides 208*e-f* that can be substantially constant, or define a substantially constant region, is less than the thickness at the respective intermediate region 210, and greater than the thickness at the proximal diverging portion 208*g*. However, this structure is not intended to be limiting, and the beams 208 can be curved, straight, of constant or varying thickness, or any combination thereof in the proximal diverging sections 208*g*, the distal converging sections 208*h*, and/or at the intermediate regions 210 that is disposed between the proximal diverging sections 208*g* and the distal converging sections 208*h*.

The mounting terminal 204 defines a through-hole or opening 212 that extends laterally through the press-fit tail 203 between the opposed beams 208, such that the inner sides 208*e* at least partially define an outer perimeter of the opening 212. In particular, the opening 212 extends longitudinally between the opposed proximal diverging sections 208*g*, the opposed intermediate regions 210, and between the opposed distal converging sections 208*h*, and extends transversely between the neck 206 and the tip 214. The opening 112 of the illustrated configuration includes a distal substantially oval-shaped portion 212*a* and a substantially transversely elongate proximal portion 212*b* shaped as a transverse elongate slot 216 that extends substantially linearly, for instance proximally from the oval-shaped portion 212*a* into the neck 206. The opening 212 is substantially keyhole-shaped having the proximal portion 212*a* that has a maximum longitudinal width and the distal portion 212*b* that has a maximum longitudinal width, wherein the maximum longitudinal width of the distal portion 212*b* is greater than the maximum longitudinal width of the proximal portion 212*a*. For instance, the proximal portion 212*b* defines a maximum longitudinal width between the opposed inner sides 208*e* that is substantially constant, for instance approximately 0.13 mm, which is less than the maximum longitudinal width of the distal portion 212*a* between the inner sides 208*e* at the intermediate regions 210, which can be for instance approximately 0.24 mm. Furthermore, the proximal portion 212*a* is discontinuous from the distal portion 212*b*, and shaped differently than the distal portion 212*b*.

The mounting terminal 204 defines a maximum longitudinal distance at the intermediate regions 210 between the outer sides 208*f* of approximately 0.55 mm Thus, the maximum longitudinal thickness of each beam 108 at the intermediate regions 110 is approximately 0.155 mm. The opening 212 can define an overall transverse length of approximately 0.71 mm. The mounting terminal 204 can define a transverse length between the distal surface 205 and the proximal end of the slot 212 of approximately 0.21 mm. The proximal and distal portions 212*a* and 212*b*, and in fact a substantially entirety of the press-fit mounting tail 203 can be substantially symmetrical about the central axis TT. The opening 212 can be described as substantially keyhole shaped. Of course, it should be appreciated that the opening 212 can define any suitable alternative geometry as desired.

At least a portion up to substantially an entirety of the inner and/or outer sides 208*e-f* of the beams 208 may be curved, for example to at least partially determine the amount of insertion force and/or withdrawal force that allows the press-fit tail 203 to be inserted into or withdrawn from the through hole 109. For example, in the illustrated configuration, a portion of the outer sides 208*f* of each beam 208, at respective intersections of the outer sides 208*f* and the front and back surfaces 208*c-d*, respectively, define curved edges 208*i*. The curved edges 208*i* can extend into the neck 206 as well in accordance with the illustrated embodiment. It should be appreciated that curved edges can also be formed at intersections between the inner sides 208*e* and the front and back surfaces 208*c-d* as desired.

During operation, referring also to FIGS. 7A-B, the electrical contact 200 is inserted into a corresponding through hole 109 that extends into an upper surface 113 of an underlying substrate, and can further extend through a lower surface 115 that is opposite the upper surface 113. Because the distance between the outer sides 208*f* of the beams is larger than the cross-sectional dimension D of the through hole 109, as the mounting terminal 204 is inserted through the through hole, the outer sides 208*f* along the distal converging sections 208*h* of the beams 208 contact and ride along the plating 119, and thus the inner wall 117. As a distal insertion force is applied to the electrical contact 200 that causes the press-fit tail 203 to be press-fit mounted to the substrate 111, the beams 208 are compressed inwardly towards each other, thereby creating an outwardly directed normal force against the plating 119 and a complementary inwardly directed normal force against the outer sides 208*f* of the beams 208. In this regard, it should be appreciated that both the tip 214 as well as the distal portions of the opposed distal converging sections 208*h* of the opposed beams 208 define a cross-sectional distance that is less than the cross-sectional distance D of the through hole 109. A proximal portion of the opposed distal converging sections 208*h* of the opposed beams 208 can define a cross-sectional distance that is greater than the cross-sectional distance D of the through hole 109. A friction force is also generated against the outer sides 208*f* of the beams 208 and against the plating 119 as the mounting terminal 204 is press-fit mounted to the substrate 111. The cumulative friction forces can provide the insertion force that allows the press-fit tail 203 of the electrical contact 200 to be inserted into the through hole 109.

The press-fit tail 203 can be withdrawn from the through hole 109, if desired, by applying a proximally directed withdrawal force to the electrical contact 210 with respect to the substrate 111 that causes the outer sides 208*f* of the beams 208 ride proximally along the plating 119. As the mounting terminal 204 moves proximally out of the through hole 109, the beams 208 are compressed inwardly towards each other, creating an outwardly directed normal force against the plating 119 and an inwardly directed normal force against the outer sides 208*f* of the beams 208. A friction force is also generated against the outer sides 208*f* of the beams 208 and against the plating 119 as the press-fit tail 203 advances proximally. The cumulative friction forces can be defined as the withdrawal, or retention force required to remove the mounting terminal 204 of the electrical contact 200 from the printed circuit board.

It has been found that when the overall length E of the illustrated configuration is approximately 1.10 mm, the press-fit tail 203 extends approximately 0.90 mm into the through hole 109 when the press-fit tail 203 is fully inserted, thereby defining a terminal stub length TSL of approximately 0.55 mm. The stub length HSL of the backdrilled through hole 109 can be substantially equal to the terminal stub length TSL, or can alternatively be greater than or less than the terminal stub length TSL. It should be appreciated that the reduced terminal stub length TSL with respect to the terminal stub length of a conventional mounting terminal allows the through hole stub length HSL to correspondingly be reduced with respect to the through hole stub length of a substrate associated with a conventional mounting terminal. Thus, the through hole stub length HSL is shorter than the through hole stub length of substrates associated with conventional press-fit tails, and the electrical contact 200 has a correspondingly reduced stub capacitance. Furthermore, it has been found that the mounting terminal 204 has a maximum insertion force of about 15 Newton (N) and a minimum withdrawal, or retention force of about 3 N. Otherwise stated, an insertion force of about 15 N applied distally to the press-fit tail 203 is sufficient to fully insert the press-fit tail 203 into the through hole 109, and 3 N of proximally oriented withdrawal force applied to the press-fit tail 203 is sufficient to remove the fully inserted press-fit tail 203 from the through hole 109. Thus, the eye-of-the-needle mounting terminal 204 defines a reduced terminal stub length TSL with respect to conventional eye-of-the-needle mounting terminals without increasing the insertion and withdrawal forces to an undesirable value. It should be appreciated that this overall length and corresponding insertion and retention forces are merely examples, and that the electrical contact 200 is not intended to be limited thereto.

Referring now to FIG. 4D, an electrical contact 300 is constructed substantially as described above with respect to the electrical contact 200 illustrated in FIG. 4C, with reference numbers corresponding to like elements incremented by 100 for the purpose of clarity. Thus, the description of the various structure of the electrical contact 200 illustrated in FIG. 4C identified by reference numerals that are incremented by 100 in FIG. 4D can equally apply to the structure of the electrical contact 300 that is identified by reference numerals incremented by 100 with respect to the structure identified in FIG. 4C, unless otherwise indicated. For instance, the beams 308 each define a thickness between the inner and outer side surfaces 308*e* and 308*f* that is substantially constant along the proximal diverging sections 308*g*, the intermediate regions 310, and the distal converging sections 308*h*. Accordingly, the inner side surface 308*e* has a contour that substantially follows the contour of the outer side surface 308*f*. The opening 312 of the electrical contact 300 is substantially diamond shaped. The mounting terminal 304 can define a maximum longitudinal width of the opening 312 between the opposed inner sides 308*e* at the intermediate regions 310 of between approximately 0.33 mm, and a maximum width between the opposed outer sides 308*f* of approximately 0.55 mm. Thus, the beams 308 can each define a thickness between the inner and outer sides 308*e-f* of approximately 0.11 mm. The terminal can further define a transverse distance between the distal surface 305 and the proximal end of the opening 312 of approximately 0.25 mm, and the opening 312 can have a transverse length of approximately 0.58 mm. The overall transverse length E of the mounting terminal 304 can be approximately 1.10 mm, and the terminal stub length TSL of approximately 0.55 mm. The stub length HSL of the backdrilled through hole 109 can be substantially equal to the terminal stub length TSL, or can alternatively be greater than or less than the terminal stub length TSL. It should be appreciated that the reduced terminal stub length TSL with respect to the terminal stub length of a conventional mounting terminal allows the through hole stub length HSL to correspondingly be reduced with respect to the through hole stub length of a substrate associated with a conventional mounting terminal.

Figure 4E:
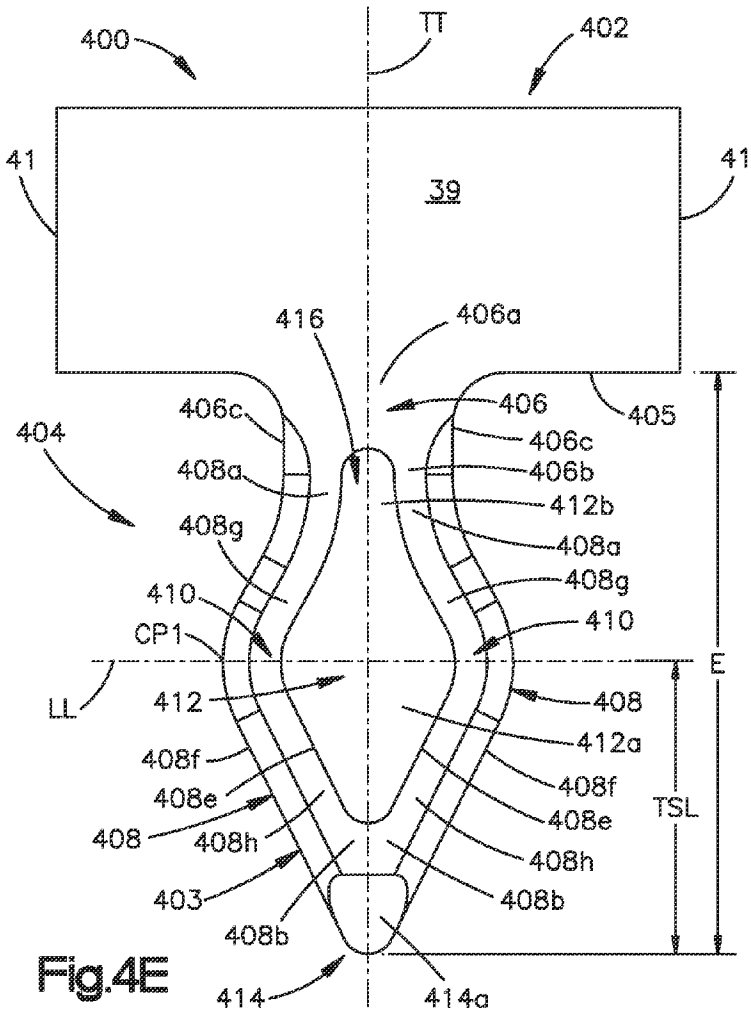
FIG. 4E is a front elevation view of a mounting terminal of an electrical contact similar to the mounting terminal illustrated in FIG. 4D, but constructed in accordance with another alternative embodiment and shown in a relaxed configuration.

Referring now to FIG. 4E, an electrical contact 400 is constructed substantially as described above with respect to the electrical contact 100 illustrated in FIG. 4D, with reference numbers corresponding to like elements incremented by 100 for the purpose of clarity. Thus, the description of the various structure of the electrical contact 300 illustrated in FIG. 4D identified by reference numerals that are incremented by 100 in FIG. 4E can equally apply to the structure of the electrical contact 400 that is identified by reference numerals incremented by 100 with respect to the structure identified in FIG. 4D, unless otherwise indicated. In accordance with the illustrated embodiment, the opening 412 of the electrical contact 400 is defined by a distal substantially diamond shaped portion 412*a* and is further defined by a proximal portion 412*b* shaped as a transverse elongate slot 416 that extends proximally from the oval-shaped portion 412*a* into the neck 406 and converges along the proximal direction, so as to define opposed convex curved surfaces between the distal portion 412*a* and the proximal end of the opening 412.

The proximal portion 412*b* defines a longitudinal width less than the maximum longitudinal width of the distal portion 412*a*. For instance, the proximal portion 412*b* can define a longitudinal width between the opposed inner sides 408*e* that is substantially constant, for instance approximately 0.10 mm, which is less than the maximum longitudinal width of the distal portion 412*a* between the inner sides 408*e* at the intermediate regions 410, which can be for instance approximately 0.33 mm. The mounting terminal 404 defines a maximum longitudinal distance at the intermediate regions 410 between the outer sides 408*f* of approximately 0.55 mm Thus, the maximum longitudinal thickness of each beam 108 at the intermediate regions 110 is approximately 0.11 mm. It should thus be appreciated that opposed beams of a mounting terminal constructed in accordance with the present disclosure can each define a thickness between the opposed outer and inner sides of any dimension described herein, for instance within a range having a lower end of approximately 0.105 mm (as described with respect to the electrical contact 100 illustrated in FIGS. 4A-B) or 0.11 mm (as described with respect to the electrical contact 400 illustrated in FIG. 4E) and an upper end of approximately 0.11 mm or 0.155 mm (as described with respect to the electrical contact 200 illustrated in FIG. 4C). The opening 212 can define an overall transverse length of approximately 0.71 mm. The mounting terminal can define a transverse length between the distal surface 205 and the proximal end of the slot 212 of approximately 0.14 mm. The opening 412 can be described as substantially keyhole shaped, and is asymmetrical about a longitudinal axis that divides the proximal portion 412*b* and the distal portion 412*a* in equal lengths. The overall length E of the mounting terminal 404 is approximately 1.10 mm and the terminal stub length TSL of the mounting terminal 404 is approximately 0.55 mm. As described with respect to the mounting terminals disclosed herein, the stub length HSL of the backdrilled through hole 109 can be substantially equal to the terminal stub length TSL, or can alternatively be greater than or less than the terminal stub length TSL. It should be appreciated that the reduced terminal stub length TSL with respect to the terminal stub length of a conventional mounting terminal allows the through hole stub length HSL to correspondingly be reduced with respect to the through hole stub length of a substrate associated with a conventional mounting terminal.

Furthermore, the beams 408 define a thickness between the inner and outer side surfaces 408*e* and 408*f* that is substantially constant along the proximal diverging sections 408*g*, the intermediate regions 410, and the lower converging sections 408*h*. Accordingly, the inner side surface 408*e* has a contour that substantially follows the contour of the outer side surface 408*f*.

Figure 5A:
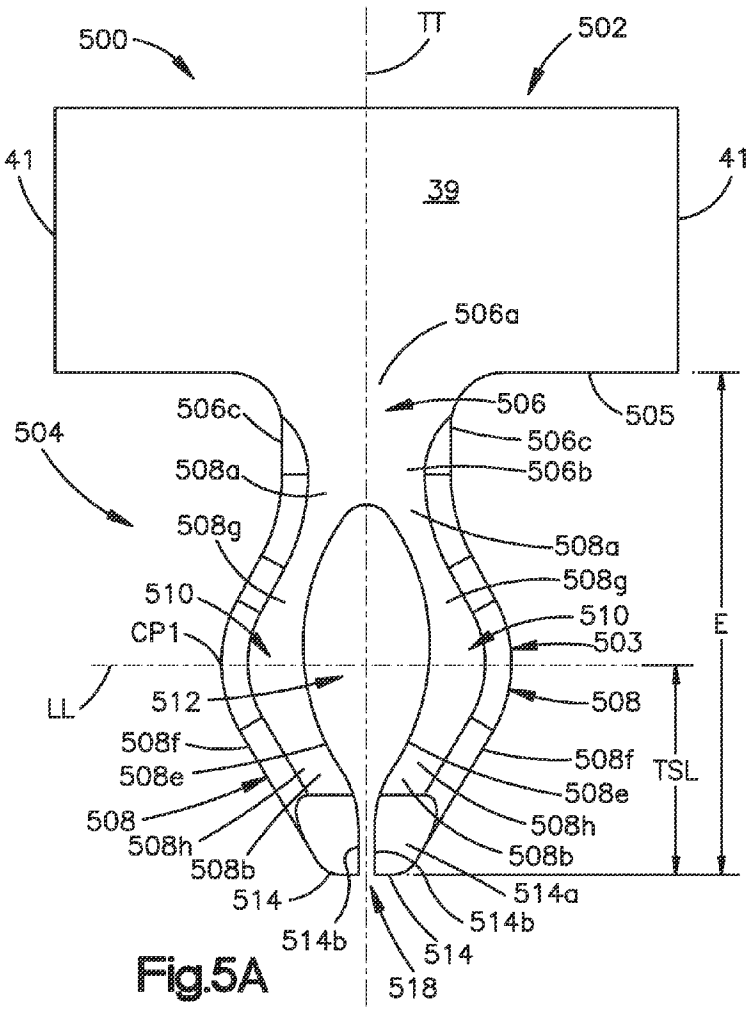
FIG. 5A is a front elevation view of a mounting terminal of an electrical contact similar to the mounting terminal illustrated in FIGS. 4A-B, but constructed in accordance with another alternative embodiment and shown in a relaxed configuration.

Referring now to FIG. 5A, an electrical contact 500 is constructed substantially as described above with respect to the electrical contact 100 illustrated in FIGS. 4A-B, with reference numbers corresponding to like elements incremented by 400 for the purpose of clarity. Thus, the description of the various structure of the electrical contact 100 illustrated in FIGS. 4A-B identified by reference numerals that are incremented by 400 in FIG. 5A can equally apply to the structure of the electrical contact 500 that is identified by reference numerals incremented by 400 with respect to the structure identified in FIGS. 4A-B, unless otherwise indicated. In accordance with the illustrated embodiment, it has been found that the mounting terminal 504 can define overall length E between the distal surface 505 and the tip 514 can be further reduced while achieving desirable insertion and withdrawal forces by splitting the beams 508 at the tip. For instance, the distal ends 508*b* of each of the beams 508 can define respective inner tip surfaces 514*b* that are separated from each other and can be spaced longitudinally apart so as to define a longitudinal gap 518 that extends longitudinally between the inner tip surfaces 514*b* when the mounting terminal 504 is in a relaxed configuration (e.g., prior to inserting the mounting terminal into the through hole 109), so as to define a split or open tip 514. The inner tip surface 514*b*, and thus the distal ends 508*b*, can be aligned with each other and configured to abut when the mounting terminal 504 is compressed.

The gap can 518 can be approximately 0.03 mm. The overall length E of the mounting terminal 504 between the distal surface and the tip 514 can be approximately 0.95 mm, which can define a terminal stub length TSL of approximately 0.40 mm. The stub length HSL of the backdrilled through hole 109 can be substantially equal to the terminal stub length TSL, or can alternatively be greater than or less than the terminal stub length TSL. It should be appreciated that the reduced terminal stub length TSL with respect to the terminal stub length of a conventional mounting terminal allows the through hole stub length HSL to correspondingly be reduced with respect to the through hole stub length of a substrate associated with a conventional mounting terminal. The terminal stub length TSL of the mounting terminal 504 is less than the terminal stub length TSL of the mounting terminals 104, 204, 304, and 404 shown in FIGS. 4B-4E. Thus, an electrical contact of the type disclosed herein can have a terminal stub length TSL between approximately 0.40 mm (electrical contact 500) and approximately 0.55mm (electrical contact 100). The mounting terminal 504 can define a transverse length between the distal surface 505 and the intermediate regions 510 of approximately 0.55 mm. The substantially oval-shaped opening 512 defines a maximum longitudinal width between the opposed inner sides 508*e* of approximately 0.24 mm, and the opposed intermediate regions 110 define a maximum longitudinal width between the opposed outer sides 108*f* of approximately 0.55 mm. Thus, the beams 108 can each define a thickness of approximately 0.105 mm.

Thus, referring also to FIGS. 7A-B, during operation, as the press-fit tail 503 is inserted into the through hole 109, the beams 508 are compressed inwardly towards each other, causing the inner tip surfaces 514*b* of the tips beams 508 abut each other, thereby closing the tip 514, so as to provide a mounting terminal 504 with a solid beam structure similar to the mounting terminal 104 of the electrical contact 100 illustrated in FIGS. 4A-B. It has been found that when the overall length E of the illustrated configuration is about 0.95 mm, the mounting terminal 504 extends about 0.75 mm into the through hole 109 of the underlying substrate 111, thereby further shortening the terminal stub length TSL, and correspondingly reducing the through hole stub length HSL, with respect to conventional press-fit tails, thereby further reducing stub capacitance, while exhibiting a maximum insertion force of about 18 N and a minimum withdrawal, or retention force of about 3 N. It should be appreciated that this overall length and corresponding insertion and retention forces are merely examples, and that the electrical contact 500 is not intended to be limited thereto.

Figure 5B:
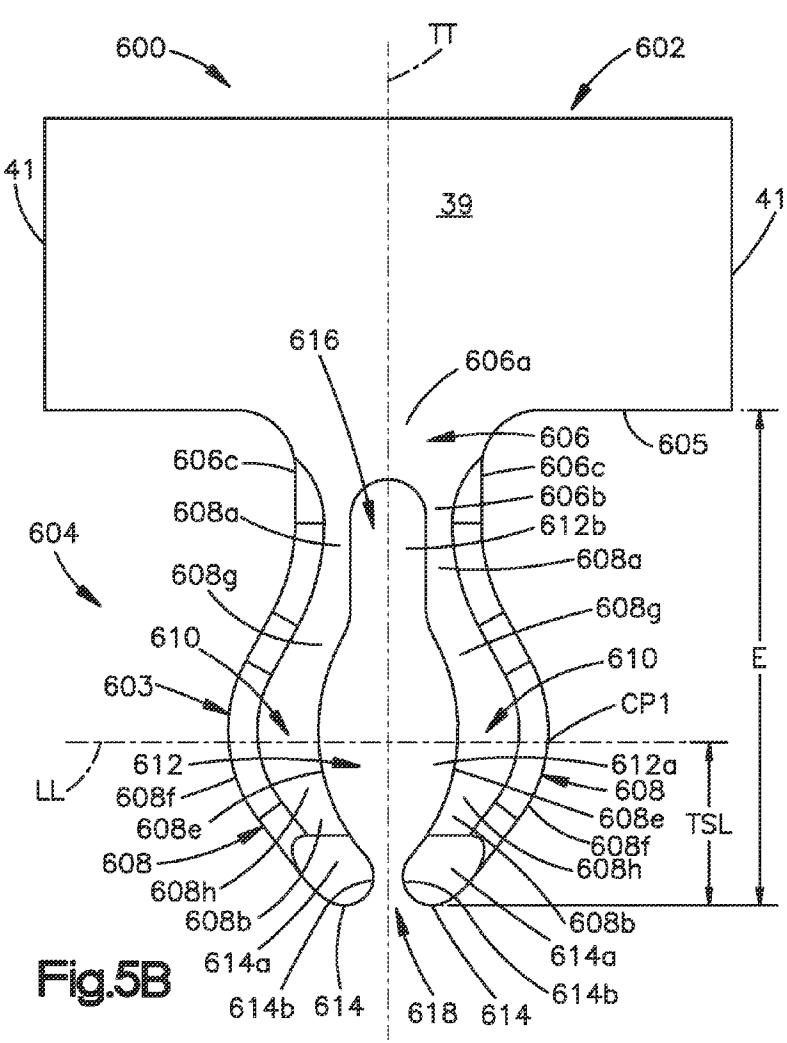
FIG. 5B is a front elevation view of a mounting terminal of an electrical contact similar to the mounting terminal illustrated in FIG. 5A, but constructed in accordance with another alternative embodiment and shown in a relaxed configuration.

Referring now to FIG. 5B, an electrical contact 600 is constructed substantially as described above with respect to the electrical contact 500 illustrated in FIG. 5A, with reference numbers corresponding to like elements incremented by 100 for the purpose of clarity. Thus, the description of the various structure of the electrical contact 500 illustrated in FIG. 5A identified by reference numerals that are incremented by 100 in FIG. 5B can equally apply to the structure of the electrical contact 600 that is identified by reference numerals incremented by 100 with respect to the structure identified in FIG. 5A, unless otherwise indicated. For instance, the opening 612 is defined by a substantially oval-shaped distal portion 612*a* and is further defined by a proximal portion 612*b* shaped as a transverse elongate slot 616 that extends proximally from the oval-shaped portion 612*a* into the neck 606 along the central axis TT. The proximal portion 612*b* defines a longitudinal width less than the maximum longitudinal width of the distal portion 612*a*, and is discontinuous with respect to the distal portion 612*a*. The opening 612 can be described as substantially keyhole shaped.

In accordance with the illustrated embodiment, the distal portion 612*a* defines a maximum longitudinal width of approximately 0.24 mm between the opposed inner sides 608*e* at the intermediate regions 610. The slot 616 can define any longitudinal width between the opposed inner sides 608*e* as described above. Furthermore, the gap 618 disposed between the inner tip surfaces 614*b* of the beams is approximately 0.05 mm. Thus, a mounting terminal having a split beam constructed in accordance with the present disclosure can define a gap between the distal ends of the beams between approximately 0.03 mm and 0.05 mm. Alternatively, as is described below with respect to FIGS. 6A-B the gap can be zero, for instance when the distal ends of the split beams contact each other in the relaxed configuration. The mounting terminal can further define an overall transverse length between the distal surface 605 and the tip 614 of approximately 0.85 mm, and a longitudinal distance between the distal surface 605 and the intermediate regions 610 of approximately 0.55 mm.

Figure 6A:
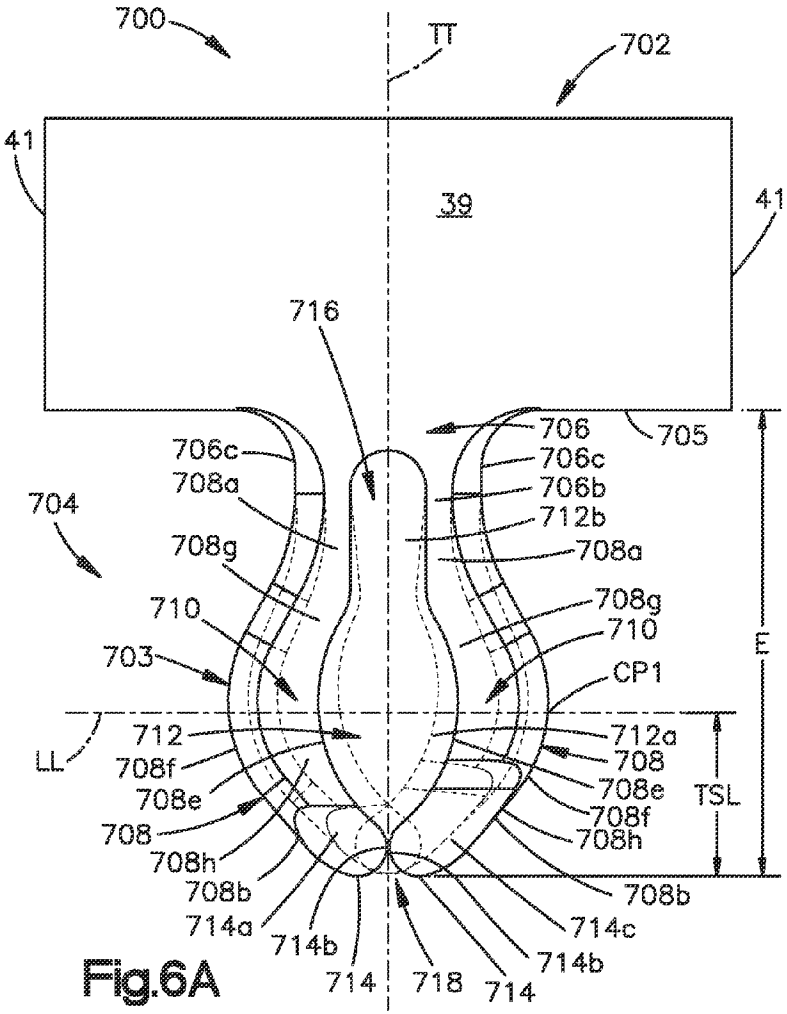
FIG. 6A is a front elevation view of a mounting terminal of an electrical contact similar to the mounting terminal illustrated in FIG. 5B, but constructed in accordance with another alternative embodiment and shown in a relaxed configuration.
Figure 6C:
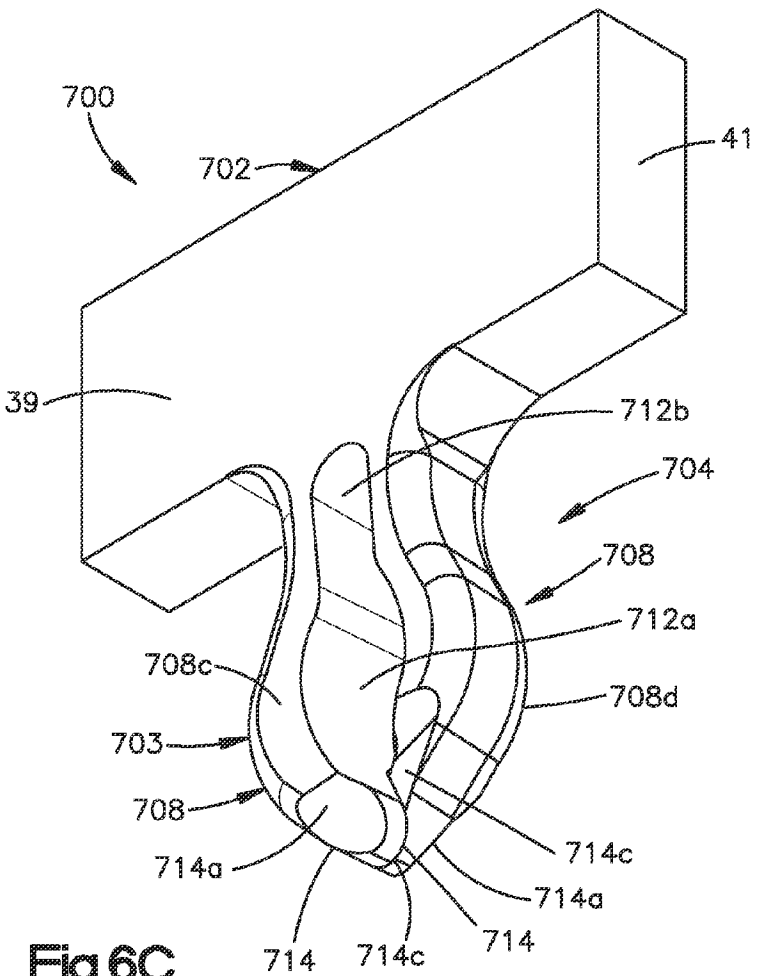
FIG. 6C is a perspective view of the electrical contact illustrated in FIG. 6A shown in a compressed configuration.
Figure 6B:
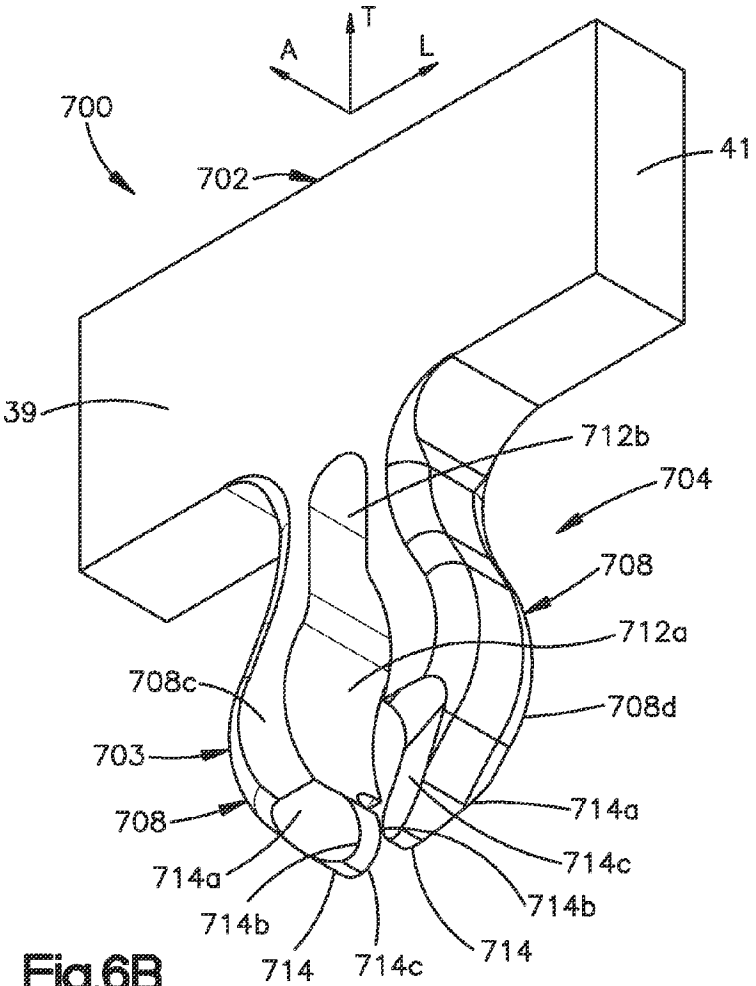
FIG. 6B is a perspective view of the electrical contact illustrated in FIG. 6A.

Referring now to FIGS. 6A-C, an electrical contact 700 is constructed substantially as described above with respect to the electrical contact 600 illustrated in FIG. 5B, with reference numbers corresponding to like elements incremented by 100 for the purpose of clarity. Thus, the description of the various structure of the electrical contact 500 illustrated in FIGS. 6A-C identified by reference numerals that are incremented by 100 in FIG. 5B can equally apply to the structure of the electrical contact 700 that is identified by reference numerals incremented by 100 with respect to the structure identified in FIG. 5*b*, unless otherwise indicated. For instance, at least one of the laterally opposed surfaces of the distal ends 708*b* of the beams 708 of the electrical contact 700 are coined, and offset in the lateral direction and thus configured to slide past each other when the beams 708 are biased inwardly towards each other when the mounting terminal 704 is compressed, for instance when the mounting terminal 704 is inserted into a complementary through hole 109 of the substrate 111. The coined surfaces of the distal ends 708*b* can ride along each other as they slide past each other, or can remain spaced from each other as they ride along each other. The coined surfaces can be tapered as desired, and thus can be initially spaced from each other as they initially slide past each other, and then be brought into contact with each other as they continue to slide past each other. Furthermore, the inner tip surfaces 714*b* can be positioned such that the gap between the inner tip surfaces is zero when the mounting terminal 704 is in the relaxed position.

The mounting terminal 704 can define a transverse length between the distal surface 705 and the intermediate regions 710 of approximately 0.5 mm. The distal portion 712*b* of the opening 712 can further define longitudinal width between the opposed inner sides 718*e* of approximately 0.24 mm, and the mounting terminal can define a longitudinal width between the opposed outer sides 718*f* of approximately 0.55 mm, such that the beams 718 can each define a longitudinal width of approximately 0.155 mm. Moreover, the mounting terminal 704 defines an overall transverse length E between the distal surface 705 and the tip 714 of approximately 0.8 mm, and defines a terminal stub length TSL of approximately 0.3 mm. The stub length HSL of the backdrilled through hole 109 can be substantially equal to the terminal stub length TSL, or can alternatively be greater than or less than the terminal stub length TSL. It should be appreciated that the reduced terminal stub length TSL with respect to the terminal stub length of a conventional mounting terminal allows the through hole stub length HSL to correspondingly be reduced with respect to the through hole stub length of a substrate associated with a conventional mounting terminal. Thus terminal stub length TSL of the mounting terminal 704 can be the same as the terminal stub length TSL of the mounting terminal 604, and less than the terminal stub length TSL of the mounting terminal 504, which is less than the terminal stub length SL of the conventional mounting terminal 87.

Thus, a method is provided to make a plurality of electrical contacts. Each of the plurality of electrical contacts has a contact body and a press fit tail that extends from the contact body. Each of the plurality of electrical contacts has a pair of opposed resilient beams that extend from the contact body (either directly or indirectly) to respective free distal ends. Each of the plurality of contacts defines a terminal stub length as described above. The method includes the step of making a first electrical contact of the plurality of electrical contacts, the first electrical contact defining a first stub length and a first gap disposed between the free distal ends of the pair of resilient beams. The method further includes the step of making a second electrical contact of the plurality of electrical contacts, the second electrical contact defining a second stub length and a second gap disposed between the free distal ends of the pair of resilient beams. The second gap is greater than the first gap, and the second stub length is less than the first stub length.

It should be further appreciated that a mounting terminal constructed in accordance with the present disclosure can each define an overall length from a distal surface of the contact body to the tip of the mounting terminal of any value as described herein, for instance within a range having a lower end of approximately 0.8 mm (as described with respect to the electrical contact 700 illustrated in FIGS. 6A-C) or approximately 0.85 (as described with respect to the electrical contact 600 illustrated in FIG. 5B) or approximately 0.95 mm (as described with respect to the electrical contact 500 illustrated in FIG. 5A), and an upper end of approximately 0.85 (as described with respect to the electrical contact 600 illustrated in FIG. 5B) or approximately 0.95 mm (as described with respect to the electrical contact 500 illustrated in FIG. 5A) or approximately 1.1 mm (as described with respect to the electrical contact 100 illustrated in FIGS. 4A-B).

In operation, as the mounting terminal 704 advances into a complementary through hole 109, the beams 708 are compressed inwardly towards each other, causing the distal ends 708*b*, and thus the distal ends 708*b* of the beams 708 to move past each other on coined ramp surfaces until they wedge tight against each other so as to create or simulate simple enclosed beams as described above with respect to the distal ends 508*b* and 608*b* of the electrical contacts 500 and 600, respectively.

The embodiments described in connection with the illustrated embodiments have been presented by way of illustration, and the present invention is therefore not intended to be limited to the disclosed embodiments. Furthermore, the structure, features, and dimensions, of each of the electrical contacts 100-700 described above can be applied to any others of the electrical contacts 100-700 described herein, unless otherwise indicated. It should furthermore be appreciated that an electrical connector can be provided having a housing and a plurality of the electrical contacts 100-700 supported by the housing, whereby one or more, up to all, of the electrical contacts 100-700 include mounting terminals in accordance with one or more, up to all, of the embodiments described herein. Additionally, the electrical connector may be constructed with a plurality of a particular one of the electrical contacts 100-700, or using any combination of the electrical contacts 100-700, as desired. Accordingly, those skilled in the art will realize that the invention is intended to encompass all modifications and alternative arrangements included within the spirit and scope of the invention, for instance as set forth by the appended claims.

What is claimed:

1. A mounting terminal of an electrical contact that extends distally from a distal surface of a contact body, the mounting terminal comprising:

a pair of opposed resilient beams defining respective proximal ends, respective distal ends opposite the proximal ends, and respective intermediate regions disposed between the proximal and distal ends, wherein the pair of opposed resilient beams are joined at their proximal ends;

wherein each of the beams defines a diverging proximal section extending distally between the proximal end and the intermediate region, and a converging lower section extending distally between the intermediate region and the distal end, so as to define an opening disposed between the beams, wherein the opening defines a substantially oval-shaped distal portion and a proximal portion that extends proximally from the distal portion, the beams defining a first width at a location where the beams are spaced furthest apart from each other in the oval-shaped distal portion, and the beams spaced closer to each other than the first width throughout the proximal portion, and wherein each of the beams defines a thickness that increases distally between the proximal end and the intermediate region, and decreases distally between the intermediate region and the distal end, such that the thickness of each of the beams is greatest at the intermediate region.

2. The mounting terminal as recited in claim 1, wherein the proximal portion of the opening extends substantially linearly from the distal portion.

3. The mounting terminal as recited in claim 1, wherein each of the opposed resilient beams defines an inner surface that at least partially defines the opening, and an opposed outer surface, and each of the opposed resilient beams defines a thickness between the inner and outer surfaces between approximately 0.105 mm and approximately 0.155 mm.

4. The mounting terminal as recited in claim 1, wherein the opposed resilient beams are joined to each other at their respective distal ends.

5. The mounting terminal as recited in claim 1, wherein the distal ends of each of the opposed resilient beams are separated from each other.

6. The mounting terminal as recited in claim 5, wherein the distal ends of each of the opposed resilient beams are configured to abut when the resilient beams are compressed toward each other.

7. A mounting terminal of an electrical contact that extends distally from a distal surface of a contact body, the mounting terminal comprising:

a pair of opposed resilient beams defining respective proximal ends, respective distal ends opposite the proximal ends, and respective intermediate regions disposed between the proximal and distal ends, wherein the pair of opposed resilient beams are joined at their proximal ends and joined at their distal ends;

wherein each of the beams defines a diverging proximal section extending distally between the proximal end and the intermediate region, and a converging lower section extending distally between the intermediate region and the distal end, so as to define an opening disposed between the beams, wherein the opening defines a substantially diamond-shaped distal portion and a proximal portion that extends proximally from the distal portion, the beams defining a first width at a location where the beams are spaced furthest apart from each other in the diamond-shaped distal portion, and the beams spaced closer to each other than the first width throughout the proximal portion.

8. The mounting terminal as recited in claim 7, wherein the proximal portion of the opening extends substantially linearly from the distal portion.

9. A mounting terminal of an electrical contact that extends distally from a distal surface of a contact body, the mounting terminal comprising:

a press-fit tail including a pair of opposed resilient beams defining respective proximal ends, respective distal ends opposite the proximal ends, and respective intermediate regions disposed between the proximal and distal ends, wherein the pair of opposed resilient beams are joined at their proximal ends and separated from each other at their distal ends, the distal ends defining coined surfaces that are configured to slide past each other as the press-fit tail is compressed, wherein each of the beams defines a thickness that increases distally between the proximal end and the intermediate region, and decreases distally between the intermediate region and the distal end, such that the thickness of each of the beams is greatest at the intermediate region, the mounting terminal defining an opening extending through the press-fit tail at a location between the pair of opposed resilient beams.

10. The mounting terminal as recited in claim 9, the opposed resilient beams further defining a gap disposed between the distal ends before the press-fit tail is compressed.

11. The mounting terminal as recited in claim 9, wherein the coined surfaces are configured to ride along each other as the distal resilient beams slide past each other.

12. An electrical contact having a contact body that defines a mating end, an opposed distal surface that is spaced from the mating end, and a mounting terminal that extends from the distal surface, the mounting terminal comprising:

a neck that defines an upper end that is integral with the distal surface of the contact body and an opposed lower end that is spaced from the upper end, the upper end of the neck defining a first cross-sectional dimension that is smaller than a second cross-sectional dimension of the distal surface of the contact body;

a pair of opposed resilient beams, each beam defining a proximal end that is integral with the lower end of the neck, an opposed distal end that is spaced from the proximal end, and a respective intermediate region that extends between the proximal and distal ends, each beam further defining a diverging section that extends distally between the proximal end and the intermediate region and a converging section that extends distally between the intermediate region and the distal end, an opening disposed between the beams, the opening having a distal portion defined by the beams and a proximal portion at least partially defined by the beams, the proximal portion extending proximally from the distal portion and into the neck, the beams defining a first width at a location where the beams are spaced furthest apart from each other in the distal portion, and the beams spaced closer to each other than the first width throughout the proximal portion.

13. The electrical contact mounting terminal as recited in claim 12, wherein the neck defines a closed end of the proximal portion of the opening, the closed end disposed between the upper and lower ends of the neck, respectively.

14. The electrical contact mounting terminal as recited in claim 12, wherein the distal ends of the beams are integral with respect to each other.

15. The electrical contact mounting terminal as recited in claim 12, wherein the distal ends of the beams define free ends that are spaced from each other.

16. The electrical contact mounting terminal as recited in claim 15, wherein the free ends are configured to abut one another when the electrical contact mounting terminal is inserted into a complementary through hole.

17. The electrical contact mounting terminal as recited in claim 15, wherein the free ends define opposed coined surfaces that are configured to slide past one another when the electrical contact mounting terminal is inserted into a complementary through hole.

18. The electrical contact mounting terminal as recited in claim 17, wherein coined surfaces are tapered such that the coined surfaces abut and ride along each as the electrical contact mounting terminal is inserted into the complementary through hole.

19. The electrical contact mounting terminal as recited in claim 12, wherein each beam defines a thickness that increases distally between the proximal end and the intermediate region, and decreases distally between the intermediate region and the distal end, such that the thickness of each beam is greatest at the intermediate region.

20. The electrical contact mounting terminal as recited in claim 12, wherein each beam defines a thickness that is substantially constant at the proximal end, the distal end, and throughout the intermediate region.

* * * * *